US011006687B1

(12) United States Patent
Chen

(10) Patent No.: US 11,006,687 B1
(45) Date of Patent: May 18, 2021

(54) MODULAR TREE WITH ROTATION-LOCK ELECTRICAL CONNECTORS

(71) Applicant: Willis Electric Co., Ltd., Taipei (TW)

(72) Inventor: Johnny Chen, Taipei (TW)

(73) Assignee: Willis Electric Co., Ltd., Taipei (TW)

( * ) Notice: Subject to any disclaimer, the term of this patent is extended or adjusted under 35 U.S.C. 154(b) by 0 days.

(21) Appl. No.: 16/593,725

(22) Filed: Oct. 4, 2019

Related U.S. Application Data

(63) Continuation of application No. 16/122,412, filed on Sep. 5, 2018, now Pat. No. 10,433,604, which is a (Continued)

(51) Int. Cl.
*F21W 121/04* (2006.01)
*A41G 1/00* (2006.01)

(Continued)

(52) U.S. Cl.
CPC ..... *A41G 1/005* (2013.01); *A41G 1/007* (2013.01); *A47G 33/06* (2013.01); *A47G 33/08* (2013.01);

(Continued)

(58) Field of Classification Search
CPC ..... A41G 1/005; A41G 1/007; A47G 33/06; F21V 23/06
See application file for complete search history.

(56) References Cited

U.S. PATENT DOCUMENTS 3,970,834 A * 7/1976 Smith ..... A47G 33/06 362/123
7,144,610 B1 * 12/2006 Estes ..... A47B 97/00 428/19

(Continued)

OTHER PUBLICATIONS

Document 94 *Polygroup Limited MCO, Appellant* v. *Willis Electric Company, LTD*, Appellee, 2018-1745, 2018-1746,2018-1747, Appeals from the United States Patent and Trademark Office, Patent Trial and Appeal Board in Nos. IPR2016-00800, IPR2016-00801, IPR2016-01609, IPR2016-01610, IPR2016-01611, IPR2016-01612, IPR2016-01613, Opinion issued Jan. 28, 2019, Opinion Modified Mar. 28, 2019 (19 pages).

(Continued)

*Primary Examiner* — Evan P Dzierzynski
(74) *Attorney, Agent, or Firm* — Christensen, Fonder, Dardi & Herbert PLLC

(57) ABSTRACT

A rotation-locking lighted artificial tree that includes a first and second portion. The first portion includes a trunk, first electrical connector, and first wiring harness. The first electrical connector includes a first body portion and a first electrical contact set. The first body portion includes multiple projections electrically isolated from the first electrical contact set. The second tree portion includes a second electrical connector and a second wiring harness. The second electrical connector includes a second body portion and a second electrical contact set, the second body portion including multiple recesses. When the first tree portion couples to the second, the first and second electrical contact sets form an electrical connection and the recesses of the second body portion receive the projections of the first body portion, thereby electrically connecting and mechanically coupling the first tree portion to the second tree portion.

20 Claims, 15 Drawing Sheets

Related U.S. Application Data continuation of application No. 15/588,159, filed on May 5, 2017, now Pat. No. 10,085,504, which is a continuation of application No. 14/730,649, filed on Jun. 4, 2015, now Pat. No. 9,648,919, which is a continuation of application No. 13/853,644, filed on Mar. 29, 2013, now Pat. No. 9,179,793.

(60) Provisional application No. 61/780,381, filed on Mar. 13, 2013, provisional application No. 61/656,752, filed on Jun. 7, 2012, provisional application No. 61/643,968, filed on May 8, 2012.

(51) Int. Cl.

| | |
|---|---|
| ***H01R 31/00*** | (2006.01) |
| ***A47G 33/08*** | (2006.01) |
| ***H01R 13/502*** | (2006.01) |
| ***F21V 23/06*** | (2006.01) |
| ***H01R 43/26*** | (2006.01) |
| ***A47G 33/06*** | (2006.01) |
| *F21W 121/00* | (2006.01) |

(52) U.S. Cl.

CPC ..... *F21V 23/06* (2013.01); *H01R 13/502* (2013.01); *H01R 31/00* (2013.01); *H01R 43/26* (2013.01); *A47G 2033/0827* (2013.01); *F21W 2121/00* (2013.01); *F21W 2121/04* (2013.01); *Y10T 29/49117* (2015.01)

(56) References Cited

U.S. PATENT DOCUMENTS

| | | | | |
|---|---|---|---|---|
| 2007/0230174 | A1* | 10/2007 | Hicks | F21S 13/14 362/249.16 |
| 2009/0289560 | A1* | 11/2009 | Oliva | A41G 1/002 315/185 S |
| 2010/0196628 | A1* | 8/2010 | Shooley | A47G 33/06 428/19 |

OTHER PUBLICATIONS

Paper 9, *Polygroup Limited, Petitioner* v. *Willis Electric Co., Ltd.*, Patent Owner, Case IPR2016-00800, Patent 8,454,186B2, Decision Granting Institution of Inter Partes Review 37 C.F.R. § 42.108, Entered Oct. 17, 2016 (22 pages).

Paper 37, *Polygroup Limited, Petitioner* v. *Willis Electric Co., Ltd.*, Patent Owner, Cases IPR2016-00800 (U.S. Pat. No. 8,121,186 B2), IPR2016-00801 (U.S. Pat. No. 8,454,187 B2), IPR2016-00802 (U.S. Pat. No. 9,044,056 B2), Termination of Trial Without Rendering Final Written Decision 37 C.F.R. §42.72, Entered Feb. 28, 2017 (3 pages).

Paper 38, *Polygroup Limited MCO, Petitioner* v. *Willis Electric Co., Ltd.*, Patent Owner, Cases IPR2016-01610 (U.S. Pat. No. 8,454,186 B2), IPR2016-01612 (U.S. Pat. No. 8,454,187 B2) IPR2016-01613 (U.S. Pat. No. 9,044,056 B2), Order, Conduct of Proceeding on Remand 37 C.F.R. §42.5, Entered Jun. 10, 2019, (5 pages).

*Polygroup Limited (MCO), Petitioner* v. *Willis Electric Co., Limited*, Patent Owner, Case IPR2016-00800, U.S. Pat. No. 8,454,186, Preliminary Response to Petition for Inter Partes Review of U.S. Pat. No. 8,454,186, dated Jul. 19, 2016 (68 pages).

Document 96, *Polygroup Limited MCO, Appellant* v. *Willis Electric Company, Ltd.*, Appellee, 2018-1745, 2018-1746, 2018-1747, Appeals from the United States Patent and Trademark Office, Patent Trial and Appeal Board in Nos. IPR2016-00800, IPR2016-00801, IPR2016-01609, IPR2016-01610, IPR2016-01611, IPR2016-01612, IPR2016-01613, On Petition for Panel Rehearing and Rehearing En Banc, filed Apr. 12, 2019 (2 pages).

Paper 8, *Polygroup Limited, Petitioner*, v. *Willis Electric Co., Ltd.*, Patent Owner, Case IPR2016-00801, U.S. Pat. No. 8,454,187 B2, Decision Granting Institution of Inter Partes Review 37 C.F.R. §42.108, Entered Oct. 17, 2016 (22 pages).

Paper 33, *Polygroup Limited, Petitoner*, v. *Willis Electric Co., Ltd.*, Patent Owner, Cases IPR2016-00800 (U.S. Pat. No. 8,454,186 B2), IPR2016-00801 (U.S. Pat. No. 8,454,187 B2) IPR2016-00802 (U.S. Pat. No. 9,044,056 B2), Termination of Trial Withour Rendering Final Written Decision 37 C.F.R. §42.72, Entered Feb. 28, 2017 (3 pages).

Paper 34, *Polygroup Limited MCO, Petitioner*, v. *Willis Electric Co., Ltd.*, Patent Owner, Cases IPR2016-01610 (U.S. Pat. No. 8,454,186 B2), IPR2016-01612 (U.S. Pat. No. 8,454,187 B2), IPR2016-01613 (U.S. Pat. No. 9,044,056 B2), Order Conduct of Proceeding on Remand 37 C.F.R. §42.5, Entered Jun. 10, 2019 (5 pages).

*Polygroup Limited (MCO), Petitioner*, v. *Willis Electric Company, Limited*, Patent Owner, Case IPR2016-00801, U.S. Pat. No. 8,454,187, Preliminary Response to Petition for Inter Partes Review of U.S. Pat. No. 8,454,187, dated Jul. 19, 2016 (70 pages).

Paper 14, *Polygroup Limited, Petitioner*, v. *Willis Electric Co., Ltd.*, Patetn Owner, Case IPR2016-01611, U.S. Pat. No. 8,454,187 B2, Decision Consolidation with IPR2016-01612 37 C.F.R. §42.122, Entered Feb. 24, 2017 (3 pages).

paper 15, *Polygroup Limited, Petitioner*, v. *Willis Electric Co., Ltd.*, Patent Owner, Case IPR2016-01609, U.S. Pat. No. 8,454,186 B2, Decision Consolidation with IPR2016-01610 37 C.F.R. §12.122, Entered Feb. 24, 2017 (3 pages).

Paper 15, *Polygroup Limited, Petitioner*, v. *Willis Electric Co., Ltd.*, Patent Owner, Case IPR2016-01610 (U.S. Pat. No. 8,454,186 B2) Case IPR2016-01612 (U.S. Pat. No. 8,454,187 B2) Final Written Decision Finding No Challeged Claims Unpatentable, Dismissing Patent Owner's Motion to Amend as Moot, Denying Patent Owner's Motion to Exclude, Denying in Part and Dismissing as Moot in Part Petitioner's Motion to Exclude, Entered Feb. 26, 2018 (82 pages).

Paper 16, *Polygroup Limited, Petitioner*, v. *Willis Electric Co., Ltd.*, Patent Owner, Case IPR2016-01610 (U.S. Pat. No. 8,454,186 B2) Case IPR2016-01612 (U.S. Pat. No. 8,454,187 B2) Final Written Decision Finding No Challenged Claims Unpatentable, Dismissing Patent Owner's Motion to Amend as Moot, Denying Patent Owner's Motion to Exclude, Denying in Part and Dismissing as Moot in Part Petitioner's Motion to Exclude, Entered Feb. 26, 2018 (82 pages).

Paper 38, *PolyGroup Limited, Petitioner*, v. *Willis Electric Co., Ltd.*, Patent Owner, Case IPR216-01610, U.S. Pat. No. 8,484,186 B2, Decision Granting Institution of Inter Partes Review 37 C.F.R. §12.108, Entered Feb. 27, 2017 (20 pages).

Paper 38, *Polygroup Limited, Petitioner*, v. *Willis Electric Co., Ltd.*, Patent Owner, Case IPR2016-01612, U.S. Pat. No. 8,454,187 B2, Decision Granting Institution of Inter Partes Review 37 C.F.R. §12.108, Entered Feb. 27, 2017 (16 pages).

Paper 187, *Polygroup Limited, Petitioner*, v. *Willis Electric Co., Ltd.*, Patent Owner, Case IPR2016-01610 (U.S. Pat. No. 8,454,186 B2) Case IPR2016-01612 (U.S. Pat. No. 8,454,187 B2) Case IPR2016-01612 (U.S. Pat. No. 8,454,187 B2), Final Written Decision, Finding No Challenged Claims Unpatentable, Dismissing Patent Owner's Motion to Amend as Moot, Denying Patent Owner's Motion to Exclude, Denying in Part and Dismissing as Moot in Part petitioner's Motion to Exclude, Entered Feb. 26, 2018 (82 pages).

Patent 211, *Polygroup Limited MCO, Petitioner*, v. *Willis Electric Co., Ltd.*, Patent Owner, IPR2016-01610 (U.S. Pat. No. 8,454,186 B2), IPR2016-01612 (U.S. Pat. No. 8,454,1877 B2), Judgement Final Written Decision on Remand Determinng Some Challenged Claims Unpatentable Granting-In-Part Patent Owner's Contingent Motion to Amend, U.S.C. §§ 144,318(a), dated Oct. 8, 2020 (40 pages).

*Polygroup Limited (MCO), Petitioner* v. *Willis Electric Company, Limited*, Patent Owner, Case IPR2016-01611, U.S. Pat. No. 8,454,187, Patent Owner Preliminary Response to Petition for Inter Partes Review of U.S. Pat. No. 8,484,187, dated Dec. 7, 2016 (74 pages).

*Polygroup Limited (MCO), Petitioner* v. *Willis Electric Company, Limited*, Patent Owner, Case IPR2016-01609, U.S. Pat. No. 8,454,186, Petition for Inter Partes Review, dated Sep. 2, 2016, (99 pages).

*Polygroup Limited (MCO), Petitioner* v. *Willis Electric Company, Limited*, Patent Owner, Case IPR2016-01610, U.S. Pat. No. 8,454,186, Petition for Inter Partes Review, dated Sep. 2, 2016 (86 pages).

(56) References Cited

OTHER PUBLICATIONS

*Polygroup Limited (MCO), Petitioner* , v. *Willis Electric Company, Limited*, Patent Owner, case IPR2016-01610, U.S. Pat. No. 8,454,186 B2, Petitioner Polygroup's Notice of Appeal, dated Dec. 10, 2020 (6 pages).

*Polygroup Limited (MCO), Petitioner* v. *Willis Electric Company, Limited*, Patent Owner, Case IPR2016-01609, U.S. Pat. No. 8,454,816, Preliminary Response to Petition of Inter Partes Review of U.S. Pat. No. 8,454,186, dated Dec. 8, 2016 (68 pages).

*Polygroup Limited (MCO), Petitioner* v. *Willis Electric Company, Limited* , Patent Owner, Case IPR2016-01610, U.S. Pat. No. 8,454,186, Preliminary Response to Petition for Inter Partes Review of U.S. Pat. No. 8,454,186, dated Dec. 8, 2016 (72 pages).

*Polygroup Limited (MCO), Petitioner* v. *Willis Electric Company, Limited*, Patent Owner, Case IPR2016-01612, U.S. Pat. No. 8,454,187, Preliminary Response to Petition for Inter Partes Review of U.S. Pat. No. 8,454,187, dated Nov. 30, 2016 (74 pages).

Paper 33, *Polygroup Limited, Petitioner*, v. *Willis Electric Co., Ltd.*, Patent Owner, Case IPR2016-016113, U.S. Pat. No. 9,044,056 B2, Decision Granting Institution of Inter Parts Review 37 C.F.R §42.108, Entered Feb. 27, 2017 (16 pages).

Paper 34, *Polygroup Limited, Petitioner*, v. *Willis Electric Co., Ltd.*, Patent Owner, Cases IPR2016-00800 (U.S. Pat. No. 8,454,186 B2), IPR2016-00801 (U.S. Pat. No. 8,454,187 B2), IPR2016-00802 (U.S. Pat. No. 9,044,056B2), Termination of Trial Without Rendering Final Written Decision 37 C.F.R. §42.72, Entered Feb. 28, 2017 (3 pages).

Paper 118, *Polygroup Limited, Petitioner*, v. *Willis Electric Co., Ltd.*, Patent Owner, Case IPR2016-01613, U.S. Pat. No. 9,044,056 B2, Final Written Decision, Finding No Claims Unpatentable, Granting Motion to Amend in Part, Dismissing as Moot in Part, Denying Patent Owners Motion to Exclude, Entered Feb. 26, 2018 (43 pages).

Paper 141, *Polygroup Limited (MCO), Petitioner* v. *Willis Electric Co., Ltd.*, Patent Owner, Case IPR2016-01613, U.S. Pat. No. 9,044,056 B2, Termination Due to Settlement After Institution of Trial 35 U.S.C. §317; 37 C.F.R. §42.74, Entered Nov. 25, 2019 (4 pages).

*Polygroup Limited (MCO), Petitioner* v. *Willis Electric Company, Limited*, Patent Owner, Case IPR2016-001613, U.S. Pat. No. 9,044,056, Patent Owner's Response U.S. Pat. No. 9,044,056, dated May 30, 2017 (72 pages).

*Polygroup Limited (MCO), Petitioner*, v. *Willis Electric Company, Limited*, Patent Owner, Case IPR2016-00802, U.S. Pat. No. 9,044,056, Petition for Inter Partes Review, dated Apr. 28, 2016 (73 pages).

*Polygroup Limited (MCO), Petitioner*, v. *Willis Electric Company, Limited*, Patent Owner, Case IPR2016-001613, U.S. Pat. No. 9,044,056, Petition for Inter Partes Review, dated Sep. 1, 2016 (91 pages).

*Polygroup Limited (MCO), Petitioner*, v. *Willis Electric Company, Limited*, Patent Owner, Case IPR2016-01613, U.S. Pat. No. 9,044,056 B2, Petitioner Polygroup's Notice of Appeal, dated Mar. 29, 2018 (6 pages).

*Polygroup Limited (MCO), Petitioner*, v. *Willis Electric Company, Limited*, Patent Owner, Case IPR2016-001613, U.S. Pat. No. 9,044,056, Preliminary Response to Petition for Inter Partes Review of U.S. Pat. No. 9,044,056, dated Dec. 9, 2016 (59 pages).

* cited by examiner

FIG.19
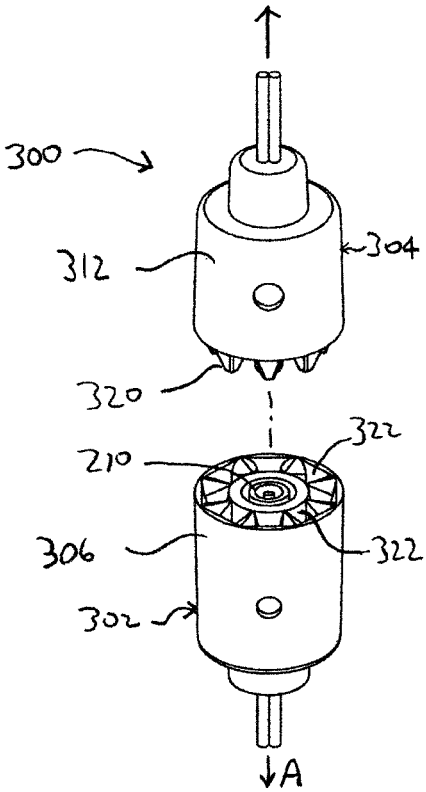
FIG.20
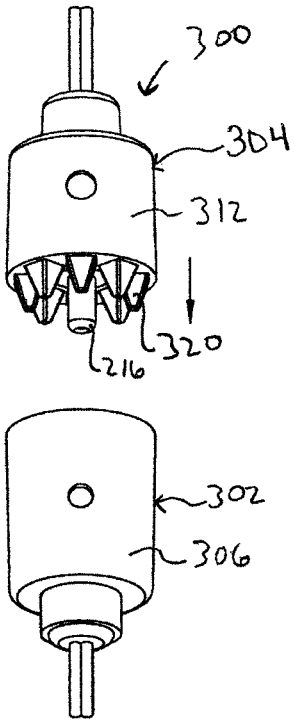
FIG.23
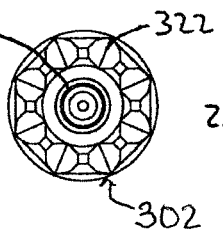
FIG.26
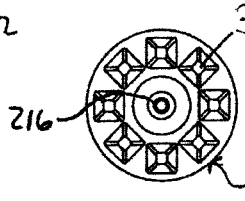
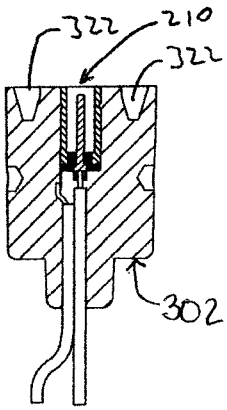
FIG.22
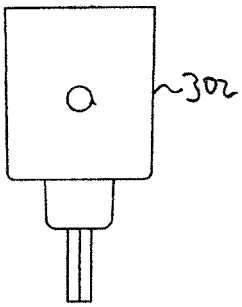
FIG.21
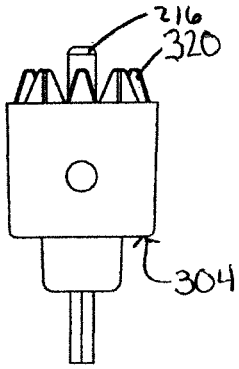
FIG.24
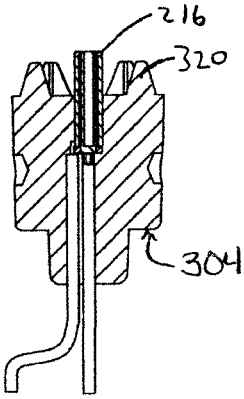
FIG.25

FIG.27
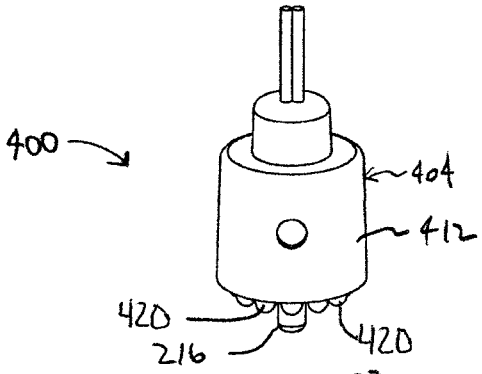
FIG.28
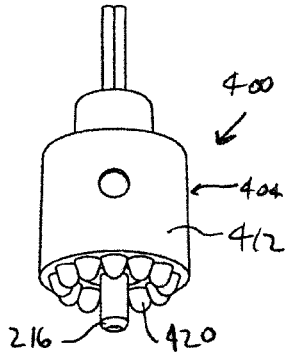
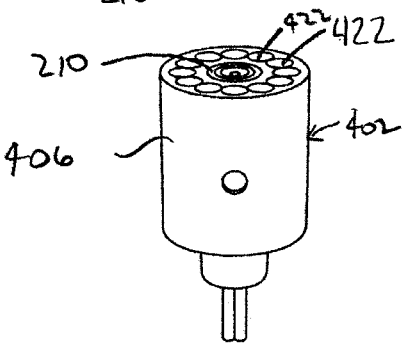
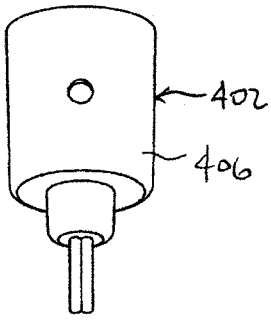
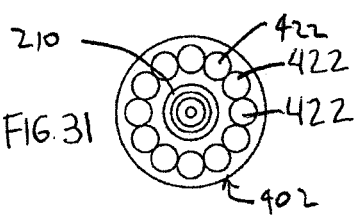
FIG.31
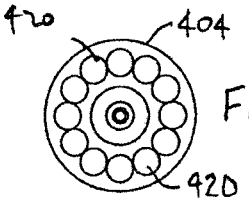
FIG.34
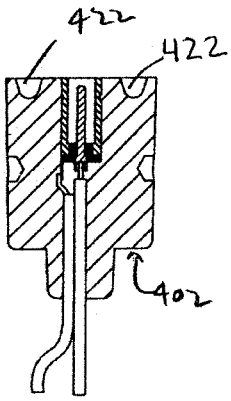
FIG.30
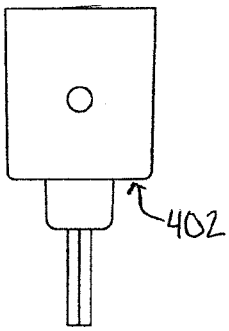
FIG.29
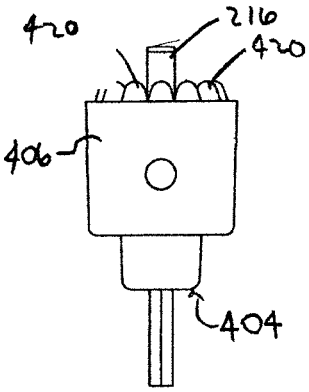
FIG.32
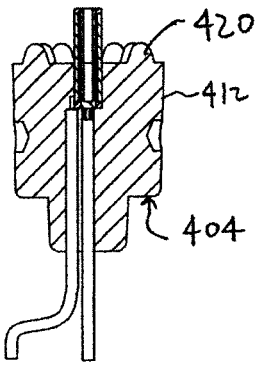
FIG.33

FIG.35
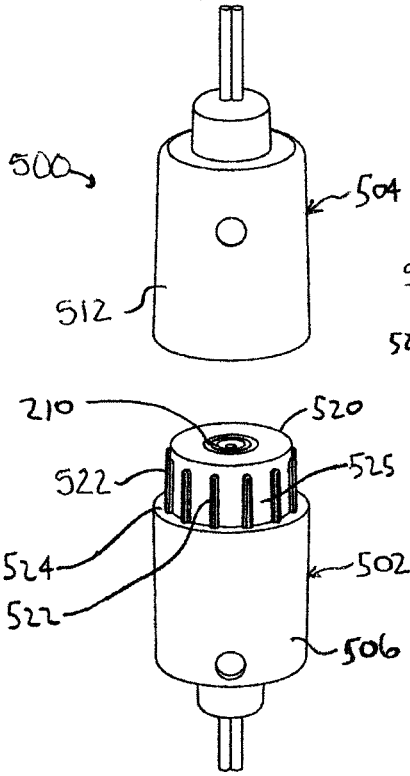
FIG.36
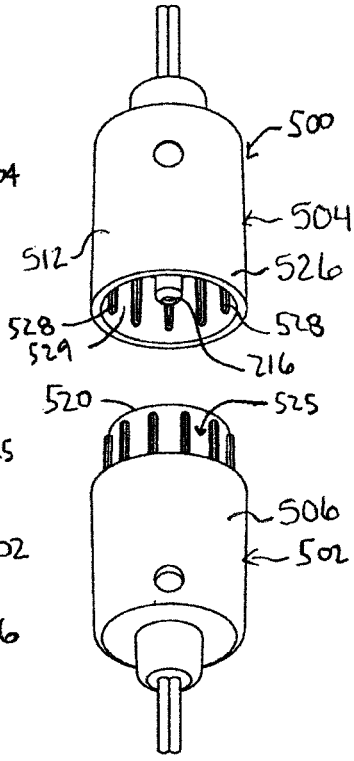
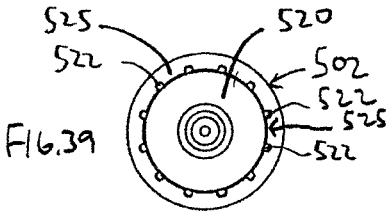
FIG.39
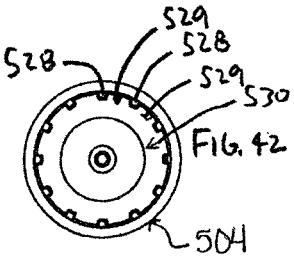
FIG. 42
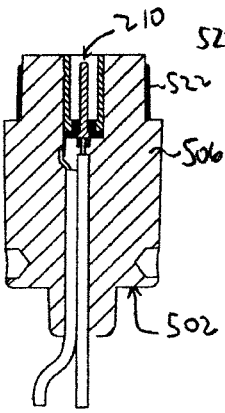
FIG.38
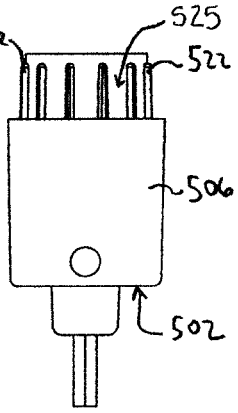
FIG.37
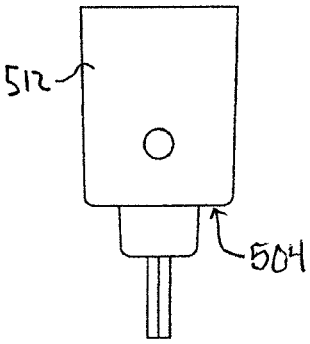
FIG.40
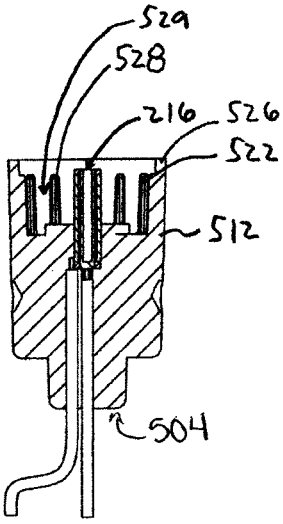
FIG.41

FIG. 43
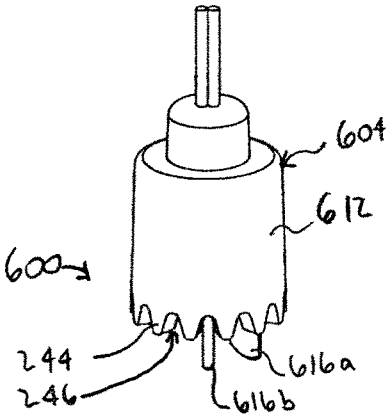
FIG. 44
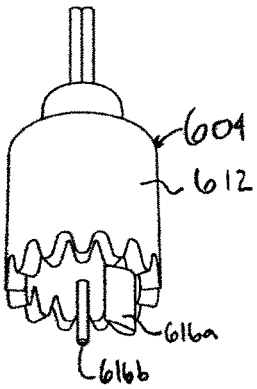
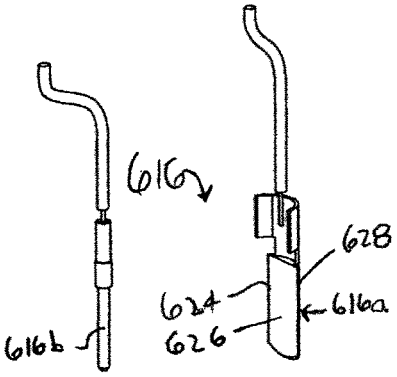
FIG. 52
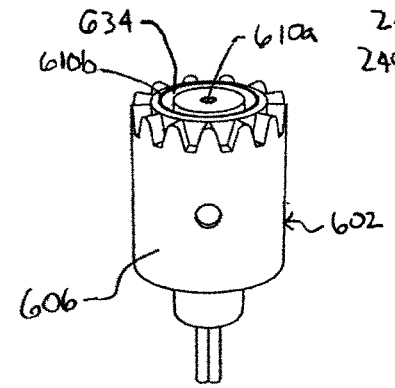
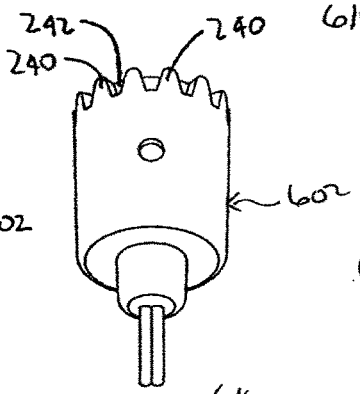
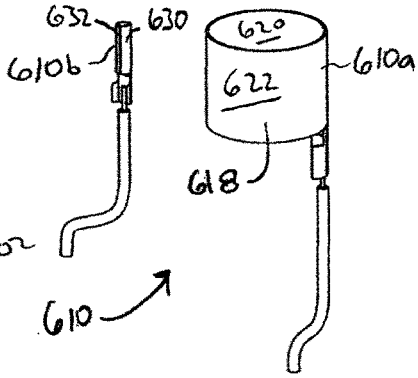
FIG. 51
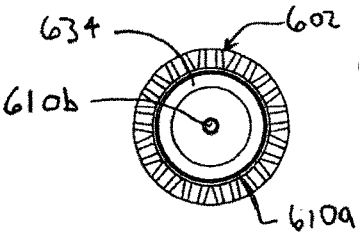
FIG. 47
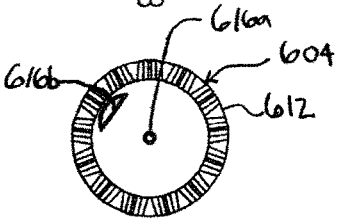
FIG. 50
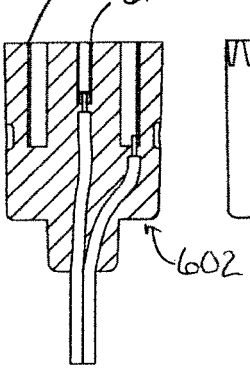
FIG. 46
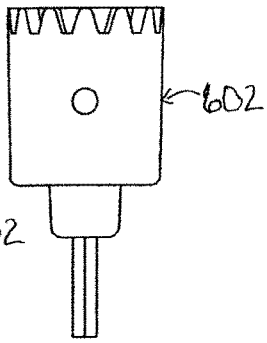
FIG. 45
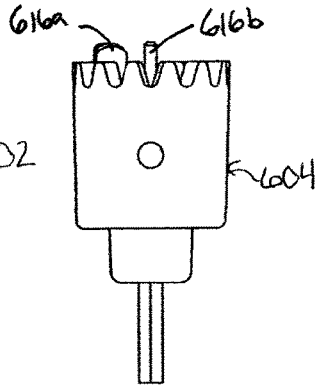
FIG. 48
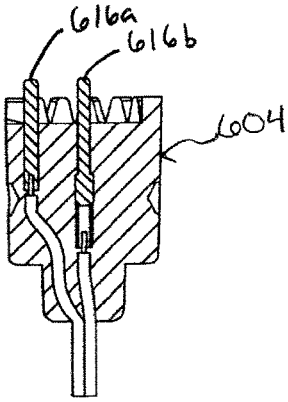
FIG. 49

FIG.53
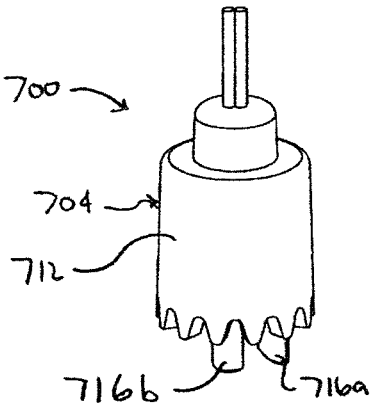
FIG.54
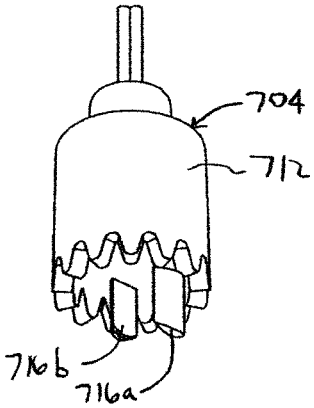
FIG. 62
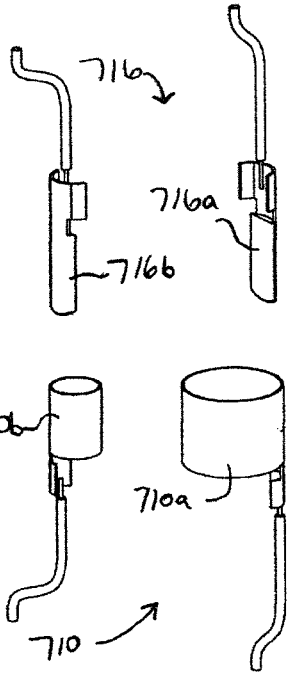
FIG.61
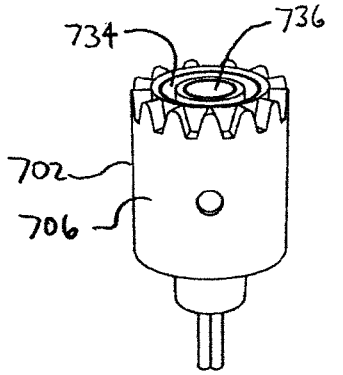
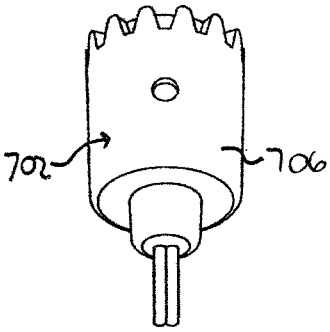
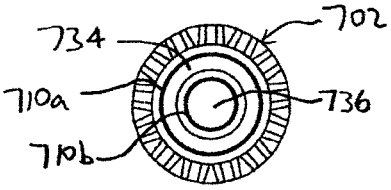
FIG.57
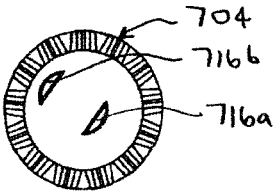
FIG.60
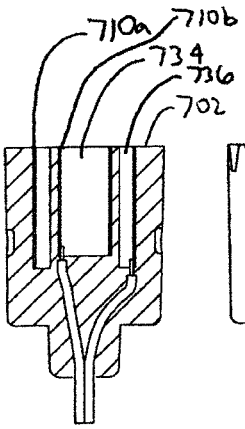
FIG.56
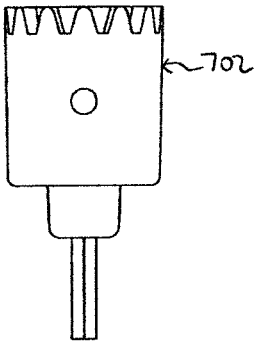
FIG.55
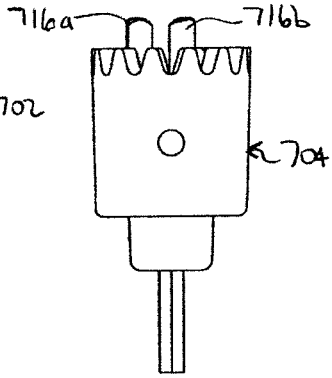
FIG.58
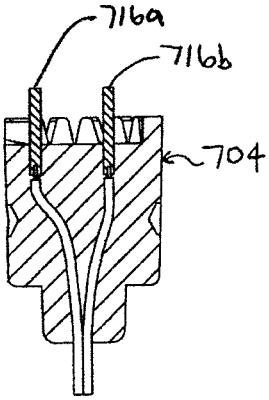
FIG.59

FIG. 63
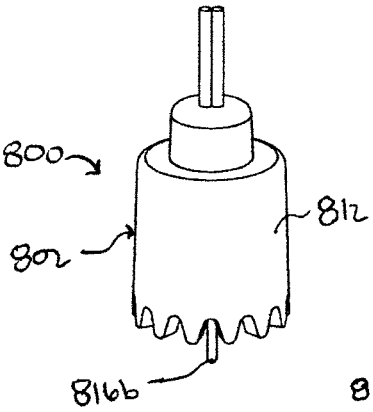
FIG. 64
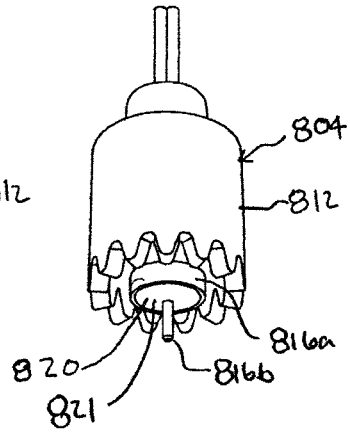
FIG. 72
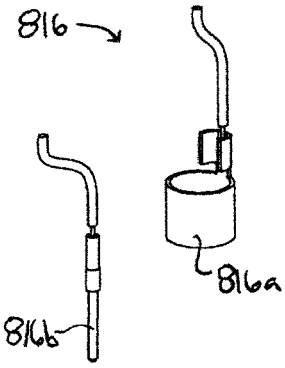
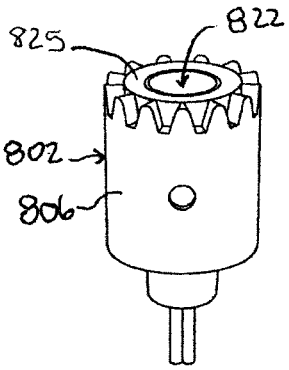
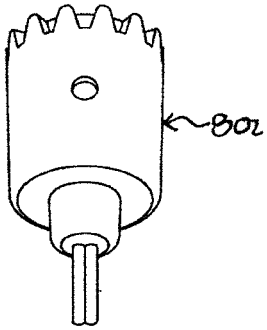
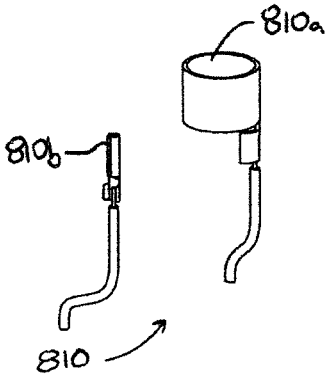
FIG. 71
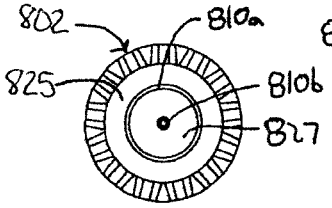
FIG. 67
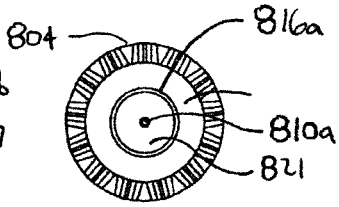
FIG. 70
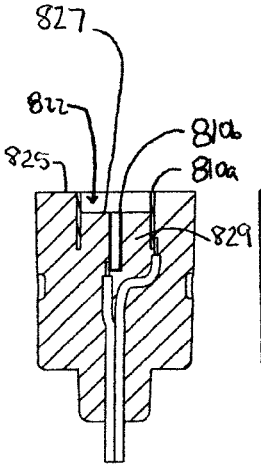
FIG. 66
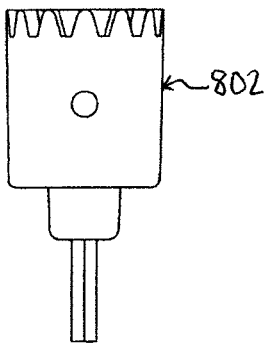
FIG. 65
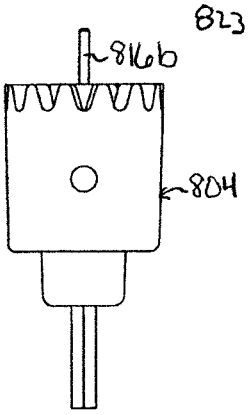
FIG. 68
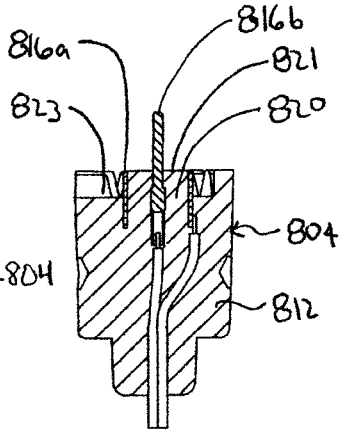
FIG. 69

900
904
912
A
648
644
646
642c
642b
952
954
956
924
642a
934c
934d
934a
934b
942c
942b
942a
916d
916c
916b
932d
932c
932a
932b
905
906
902

916a
913
916b
916c 916d
911
907
909
924
942a
950
952
942b 942c
954
956
916a
916b
913
911
909
916c
907
916d
932a
932d
932b
932c

A

A 956
954
952
942c
924
942b
950
942a
934d
904
934a
934c
934b

FIG. 83
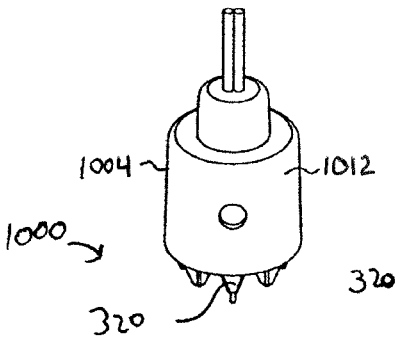
FIG. 84
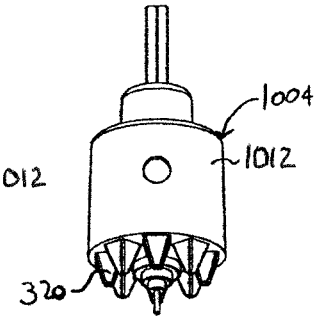
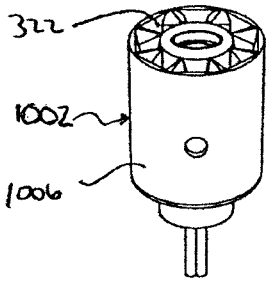
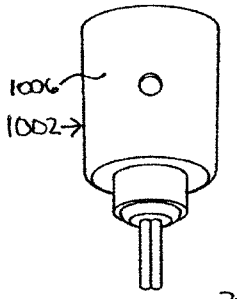
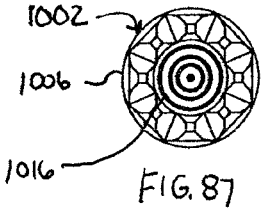
FIG. 87
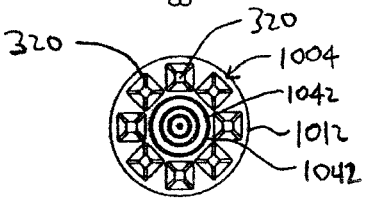
FIG. 90
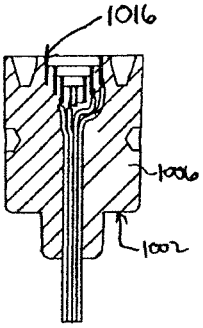
FIG. 86
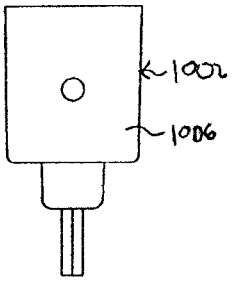
FIG. 85
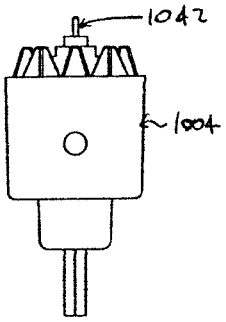
FIG. 88
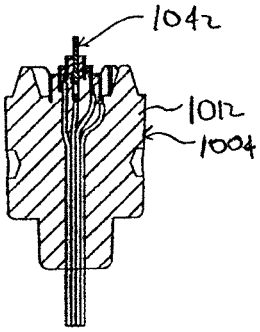
FIG. 89

MODULAR TREE WITH ROTATION-LOCK ELECTRICAL CONNECTORS

RELATED APPLICATIONS

The present application is a continuation of U.S. patent application Ser. No. 16/122,412, filed Sep. 5, 2018, which is a continuation of U.S. patent application Ser. No. 15/588,159, filed May 5, 2017, now U.S. Pat. No. 10,085,504, which is a continuation of U.S. patent application Ser. No. 14/730,649, filed Jun. 4, 2015, now U.S. Pat. No. 9,648,919, which is a continuation of U.S. patent application Ser. No. 13/853,644, filed Mar. 29, 2013, now U.S. Pat. No. 9,179,793, which claims the benefit of U.S. Provisional Application No. 61/780,381 filed Mar. 13, 2013, U.S. Provisional Application No. 61/656,752, filed Jun. 7, 2012, and U.S. Provisional Application No. 61/643,968 filed May 8, 2012, all of which are incorporated herein in their entireties by reference.

FIELD OF THE INVENTION

The present invention is generally directed to artificial trees. More specifically, the present invention is directed to artificial trees having separable, modular tree portions electrically connectable between trunk portions, and having rotation-lock electrical connectors.

BACKGROUND OF THE INVENTION

For the sake of convenience and safety, consumers often substitute artificial trees constructed of metal and plastic for natural evergreen trees when decorating homes, offices, and other spaces, especially during the holidays. Such artificial trees generally include multiple tree sections joined at the trunk and held erect by a floor-based tree stand. Traditionally, consumers wrap strings of lights about the artificial tree to enhance the decorative quality of the tree display. As more and more decorative light strings are draped around the tree, it becomes more and more difficult to provide power to the various light strings distributed throughout the tree.

To ease this burden to the consumer, manufacturers have created "pre-lit" or lighted artificial trees. Typical pre-lit trees include an artificial tree with multiple standard light strings distributed about the exterior of the tree. Wires of the light string are clipped to branch structures, while plug ends dangle throughout the branches. Generally, multi-purpose decorative light strings are used in pre-lit trees, often limited to 50 or 100 bulb assemblies, with a bladed power plug for insertion into the back outlet of another light string, or insertion into an alternating current (AC) power source.

As the popularity of such pre-lit trees has grown, so to have the bulk and complexity of pre-lit trees. Along with an increase in the number and density of branches of a typical pre-lit tree comes an increase in the number of lights and light strings on the pre-lit tree. This increased number of branches and lights can significantly increase the weight of the pre-lit tree making it difficult to lift and align individual trunk sections when assembling the tree. Further, the increased number of lights per tree, often as high as 1,000 or 1,500 lights, drastically increases the complexity of interconnecting and powering the numerous light strings.

It can be difficult to find and then properly connect the necessary plugs in order to power all of the light strings on the tree. Light strings may be connected to one another within a given tree section, or sometimes between sections, by connecting the strings end to end. Consumers need to be careful to follow the manufacturer's guidelines and not plug too many light strings together end-to-end and surpass the current-carrying capacity of the light string wiring. Due to such limitations, power plugs of the light strings may include receptacles for receiving other power plugs such that the power plugs may be "stacked" together, plugging one into the other. Short extension cords may be strung along the outside of the trunk to carry power to the various interconnected light strings. The result is a complex web of lighting that often requires a consumer to not only interconnect the plugs and receptacles of individual light strings together, but to stack and plug multiple light strings and cords into multiple power outlets.

Some known inventions have attempted to simplify the electrical connection of pre-lit trees by enclosing light wiring within the trunk of the tree and tree sections. For example, U.S. Pat. No. 1,656,148 to Harris filed Apr. 5, 1926 and entitled "Artificial Christmas Tree" teaches a simple artificial tree with one embodiment having multiple tree sections that join together. The tree includes single bulbs at each end of a branch, with bulb wiring extending from inside a trunk through hollow branches. A bayonet fitting is used to adjoin the sections, a top section having a projecting pin, and a bottom section having an L-shaped bayonet slot. The two sections are coupled by aligning the projection pin with the bayonet slot and rotating to interlock the sections, thereby bringing a pair of spring contacts into alignment with a pair of terminals to make an electrical connection.

Another known artificial tree as described in U.S. Pat. No. 3,970,834 to Smith, filed Dec. 16, 1974 and entitled "Artificial Tree", describes a pre-lit tree made in sections which may be folded for easy storage. The individual tree sections include a threaded male end and a threaded female socket end. The male end of a tree section is aligned with, then screwed into, the female end of another section. Wiring for the lights passes from the trunk through holes in branches and connects with individual lights at an interior of the branch. When the tree is completely screwed together, an electrical connection is made.

Yet another known artificial, lighted tree as described in U.S. Pat. No. 8,053,042 to Loomis, filed Jul. 1, 2010 and entitled "Artificial Tree Apparatus", describes a pre-lit tree having a first trunk segment with an electrical socket that couples together with a second trunk segment having an electrical plug. The tree segments also include a guide slot and detent structure on the trunk segments. To electrically and mechanically couple the first and second tree segments, the socket and plug must be aligned at the same time that the guide slot and detent are aligned.

A common feature of such known trees is that the first and second tree segments must be aligned in a particular position, or rotational orientation, in order to electrically and mechanically couple the two tree sections. However, the larger the size and heavier the tree, the more difficult it can be for a user to manipulate the two tree segments into alignment.

Conversely, some of the more traditional pre-lit trees with wiring outside the trunk may include tree sections that can be mechanically coupled in nearly any rotational alignment of the two trunk sections. However, depending on the coupling structure, the two tree sections may be able to rotate relative to another. Such rotation may be undesirable for both aesthetic and more practical reasons. For example, if a tree is in a corner, it may be decorated only on one side. Rotation of one of the tree sections relative to the other changes the decorative appearance of the tree. In another example, if one tree section is bumped or otherwise rotated relative to another, portions of the light string may become detached from the tree, or worse, wires may become detached from their lamp sockets or plugs.

BRIEF DESCRIPTION OF THE FIGURES

The invention can be understood in consideration of the following detailed description of various embodiments of the invention in connection with the accompanying drawings, in which:

FIGS. 19-26 depict another rotation-lock electrical connector system having pyramidal engagement portions, according to an embodiment of the claimed invention;

FIGS. 27-34 depict another rotation-lock electrical connector system having domed engagement portions, according to an embodiment of the claimed invention;

FIGS. 35-42 depict another rotation-lock electrical connector system having ridged engagement portions, according to an embodiment of the claimed invention;

FIGS. 43-52 depict another rotation-lock electrical connector system having an alternate electrical contact set, according to an embodiment of the claimed invention;

FIGS. 53-62 depict another rotation-lock electrical connector system having an alternate electrical contact set, according to an embodiment of the claimed invention;

FIGS. 63-72 depict another rotation-lock electrical connector system having an alternate electrical contact set, according to an embodiment of the claimed invention;

FIGS. 83-90 depict a tiered rotation-lock electrical connector system having a four-pole electrical contact set and having pyramidal engagement portions, according to an embodiment of the claimed invention.

Figure 1:
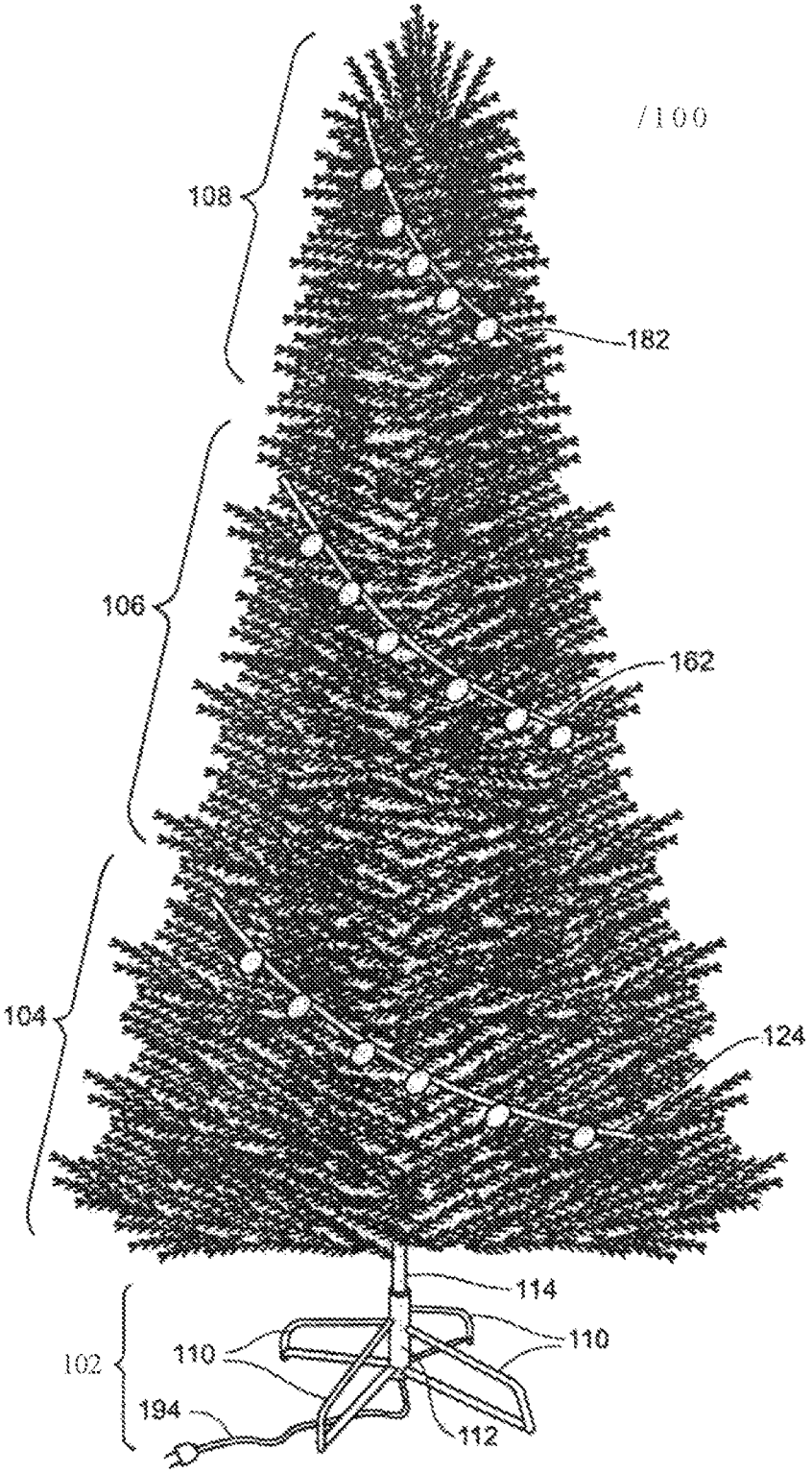
FIG. 1 depicts a lighted, artificial tree, according to an embodiment of the claimed invention.

While the invention is amenable to various modifications and alternative forms, specifics thereof have been shown by way of example in the drawings and will be described in detail. It should be understood, however, that the intention is not to limit the invention to the particular embodiments described. On the contrary, the intention is to cover all modifications, equivalents, and alternatives falling within the spirit and scope of the invention as defined by the appended claims.

SUMMARY OF THE INVENTION

Embodiments of the claimed invention solve the identified shortcomings of the prior art by providing lighted artificial trees and connection systems that have trunk sections or portions that may be easily aligned and coupled, yet are not readily rotated relative to one another after coupling.

In an embodiment, the claimed invention comprises a rotation-locking lighted artificial tree. The tree comprises: a first tree portion, including a first trunk portion and a first electrical connection and wiring assembly, the first electrical connection and wiring assembly housed at least in part within the first trunk portion, and including a first electrical connector assembly and a first wiring harness, the first electrical connector assembly including a first body portion and a first electrical contact set, the first electrical contact set in electrical connection with the first wiring harness, the first body portion including a plurality of projections, the plurality of projections electrically isolated from the first electrical contact set; and a second tree portion, including a second trunk portion and a second electrical connection and wiring assembly, the second electrical connection and wiring assembly housed at least in part within the second trunk portion, and including a second electrical connector assembly and a second wiring harness, the second electrical connector assembly including a second body portion and a second electrical contact set, the second electrical contact set in electrical connection with the second wiring harness, the second body portion including a plurality of recesses. Wherein the first tree portion is configured to couple to the second tree portion such that the first electrical contact set and the second electrical contact set form an electrical connection and the plurality of recesses of the second body portion receive the plurality of projections of the first body portion, thereby electrically connecting the first wiring harness to the second wiring harness and mechanically coupling the first tree portion to the second tree portion.

In another embodiment, an embodiment of the claimed invention comprises a rotation-lock tree-coupling system. The system comprises a first electrical connection and wiring assembly including a first electrical connector assembly and a first wiring harness, the first electrical connector assembly including a first body portion and a first electrical contact set, the first electrical contact set in electrical connection with the first wiring harness, the first body portion including a plurality of projections extending axially away from the first body, the plurality of projections electrically isolated from the first contact set; and a second electrical connection and wiring assembly, the second electrical connection and wiring assembly including a second electrical connector assembly and a second wiring harness, the second electrical connector assembly including a second body portion and a second electrical contact set, the second electrical contact set in electrical connection with the second wiring harness, the second body portion including a plurality of recesses. Wherein the first body portion is configured to couple to the second body portion such that the first electrical contact set and the second electrical contact set form an electrical connection and the plurality of recesses of the second body portion receive the plurality of projections of the first body portion, thereby electrically connecting the first wiring harness to the second wiring harness and mechanically coupling the first body portion to the second body portion.

In yet another embodiment, the claimed invention comprises a lighted artificial tree, the tree comprising: a first tree portion, including a first trunk portion and a first electrical connector, the first electrical connector housed at least in part within a first end of the first trunk portion, and including a first body portion and a first electrical contact set, the first body portion including a plurality of non-conductive first axially-extending engagement portions; and a second tree portion, including a second trunk portion and a second electrical connector, the second trunk portion having a trunk wall defining a second end defining an opening configured to receive the first end of the first trunk portion, the trunk wall being contiguous about a circumference of the opening of the second end, the second electrical connector including a second body portion and a second electrical contact set, the second body portion including a plurality of non-conductive second engagement portions. Wherein the first tree portion is configured to couple to the second tree portion such that the trunk wall of the second portion engages and receives the first end of the first tree portion, and the plurality of first engagement portions of the first body portion of the first tree portion engage the plurality of second engagement portions of the second body portion, and the first electrical contact set and the second electrical contact set form an electrical connection.

In other embodiments, the claimed invention comprises methods of coupling a first tree portion to a second tree portion, and methods of manufacturing modular, rotation-locking artificial trees, as described herein.

In one such embodiment, the claimed invention comprises a method of electrically and mechanically coupling a first tree portion of a lighted artificial tree to a second tree portion. The method comprises aligning a first tree portion having a first generally hollow trunk portion and an electrical connector, along a vertical axis; aligning a second tree portion having a second generally hollow trunk portion and a second electrical connector along the vertical axis; causing one of the first or the second tree portions to move axially such that the second tree portion receives an end of the first tree portion, and the first trunk wall is engaged with the second trunk wall; causing the first electrical connector at a first sloped engagement portion to initially contact a second sloped engagement portion of the second electrical connector prior to a final engagement position, and at a first rotational alignment; allowing a torque caused by a downward force of a weight of the second tree portion to rotate the second electrical connector relative the first electrical connector, thereby rotating the first tree portion into a final rotational alignment with the second tree portion.

DETAILED DESCRIPTION

Referring to FIG. 1, an embodiment of modular lighted tree 100 with rotation-lock electrical connectors according to the claimed invention is depicted. Modular tree 100 includes base portion 102, first lighted tree portion 104, second lighted tree portion 106, and third lighted tree portion 108. In some embodiments, modular tree 100 may include more lighted tree portions, such as a fourth lighted tree portion, or may include fewer lighted tree portions. When tree 100 is assembled, as depicted, lighted tree portions 104, 106, and 108 are aligned along a common vertical axis A (see also FIG. 2) and held in a generally vertical orientation by base portion 102.

Base portion 102 as depicted includes multiple legs 110 connected to a central trunk-support portion 112. As depicted, trunk support portion 112 may be generally cylindrical to receive and support first tree portion 104. Base portion 102 may include an optional base-trunk portion 114 extending upwardly from trunk support portion 112 to form a portion of a trunk of tree 100. In other embodiments, base portion 102 may comprise other configurations capable of supporting and aligning tree portions 104, 106, and 108 in a steady, upright manner. Such alternate embodiments include a base portion having more or fewer legs 110, an integrated structure with an opening for receiving first lighted tree portion 104, and other such embodiments.

Figure 2:
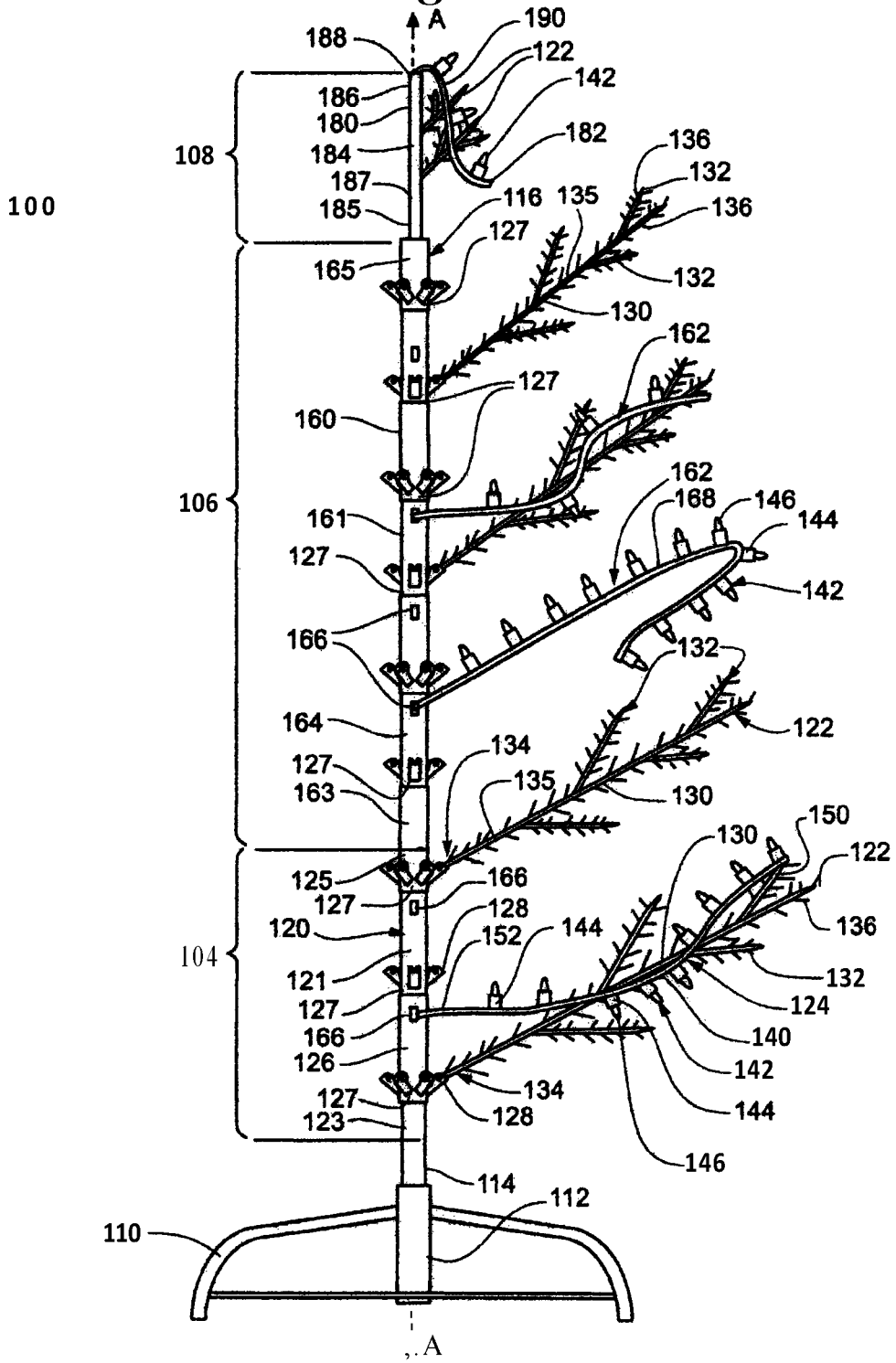
FIG. 2 depicts the tree of FIG. 1, with branches removed.

Referring also to FIG. 2, modular tree 100 is depicted in an assembled configuration, with multiple branches and light strings removed for illustrative purposes.

As depicted, first lighted tree portion 104 includes first trunk portion 120, multiple branches 122, and one or more first light strings 124.

First trunk portion 120 as depicted comprises a generally cylindrical, hollow structure including trunk portion body 121 having a first end 123, second end 125, outside wall 126, and one or more branch-support rings 127. First trunk portion 120 also defines multiple openings 166 in wall 126.

Branch-support rings 127 include multiple branch receivers 128 extending outwardly and away from trunk portion 120. In some embodiments, branch receivers 128 define a channel for receiving a trunk end of a branch 122.

Each branch 122 generally includes primary branch extension 130 and may also include multiple secondary branch extensions 132 extending away from branch extension 130. Branch 122 is connected to trunk portion 120 at a branch receiver 128 at trunk-end 134. In some embodiments, as depicted, branches 122 include strands 136 simulating the needles found on natural pine or coniferous trees. Strands 136 are attached to branch frame 135, which in some embodiments comprises a solid-core frame, such as a metal rod, wire, multiple twisted wires or rods, or similar such materials. In other embodiments, frame 135 may be hollow.

Trunk ends of branches 122 may be bent or otherwise formed to define a loop or circular opening such that trunk end 134 of branch 122 may be secured to branch receiver 128 by way of a pin (not depicted) extending through branch receiver 128 and the loop formed at trunk end 134 of branch 122. In this way, a branch 122 may be allowed to pivot about the pin and branch receiver 128, allowing tree portion 104 to collapse to a smaller envelope size for convenient storage.

First light string 124 includes light string wiring 140 and a plurality of lighting element assemblies 142. Each lighting assembly element 142 includes housing 144 and lighting element 146. Lighting elements 146 may comprise incandescent bulbs, light-emitting diodes, a combination thereof, or any of other known types of light-emitting elements.

Lighting elements 146 may be electrically connected in parallel, series, or a combination of series and parallel, to form a parallel-connected, series-connected, parallel-series connected, or series-parallel connected first light string 124.

First light string 124 is affixed to one or more branches 122 of lighted tree portion 104 via multiple clips 150. A proximal end 152 of light string 124 may be connected to outside wall 126 of first trunk portion 120 by a connector or clip as described further below, or may be inserted through an opening 166 in wall 126 into an interior space defined by first trunk portion 120.

In one embodiment, first lighted tree portion 104 includes a plurality of first light strings 124. Such first light strings 124 may be substantially the same, for example, a series-parallel connected light string having 100 lighting element assemblies 142. In other embodiments, first lighted tree portion 104 may include first light strings 124 having a particular configuration and other first light strings 124 having another, different configuration. For example, first light strings 124 located closer to base portion 102 may be longer in length with more light emitting assemblies 142, while first light strings 124 further from base portion 102 may be relatively shorter in length, with fewer light emitting assemblies 142. In other embodiments, first lighted tree portion 104 may include only a single light string 124.

Second lighted tree portion 106, adjacent first lighted tree portion 104, is similar to lighted tree portion 104 and includes second trunk portion 160, multiple branches 122 and one or more second light strings 162.

Second trunk portion 160 as depicted also comprises a generally cylindrical, hollow structure including trunk portion body 161 having a first end 163, a second end 165, outside wall 164, and one or more branch-support rings 127. First trunk portion 120 also defines multiple openings 166 in wall 164.

In an embodiment, trunk portion body 161 and its wall 164 define an end opening in first end 163, which receives end 123 of first tree portion 104. In an embodiment, trunk wall 164 is contiguous about the end opening, such that it does not have through slots, thereby improving the structural strength of the trunk wall and trunk body as compared to known, slotted trunks.

In one embodiment, trunk portion 160 may have a trunk diameter that is substantially equal to a trunk diameter of first trunk portion 120, while in other embodiments, may have a trunk diameter that is different from that of the first trunk portion. In one such embodiment, a trunk diameter of second trunk portion 160 is slightly greater than a trunk diameter of first trunk portion 120 such that that trunk 116 has a somewhat tapered look.

Similar to first light strings 124, second light strings 162 may comprise any combination of series-connected or parallel-connected individual or groupings of lighting element assemblies 142.

Third lighted tree portion 108, adjacent to second lighted tree portion 106 includes third trunk portion 180, branches 122, and one or more third light strings 182. In some embodiments, such as the depicted embodiment, a diameter of third trunk portion 180 may be somewhat smaller in diameter than a diameter of second lighted tree portion 108. As depicted, third trunk portion 180 comprises a relatively smaller diameter pipe-like body portion 184 including lower end 185, upper end 186, trunk wall 187, and defining top opening 188 (see also FIGS. 3 and 4). Also as depicted, in some embodiments, third trunk portion 180 may also not include branch-support rings 127, as branches 122 of third lighted tree portion 108 may be somewhat shorter in length than branches 122 of second lighted tree sections 106 and may be directly connected to body portion 184 of third trunk portion 180.

Third light string 182 includes wiring 190 and multiple lighting element assemblies 142. Similar to first light strings 124, third light strings 182 may comprise any combination of series-connected or parallel-connected individual or groups of lighting element assemblies 142.

In the embodiment depicted, third light string 182 emerges from top opening 188 such that a portion of third light string 182 is within an interior space defined by third trunk portion 180. Alternatively, third light string 182 may be connected via an electrical connector at opening 188. In other embodiments, third light string is mechanically connected to trunk portion via a connector at wall 186 of third trunk portion 180, or may be received in part by an opening (not depicted) in wall 186. In yet other embodiments, third light string 182 may be an extension of second light string 162.

Figure 3:
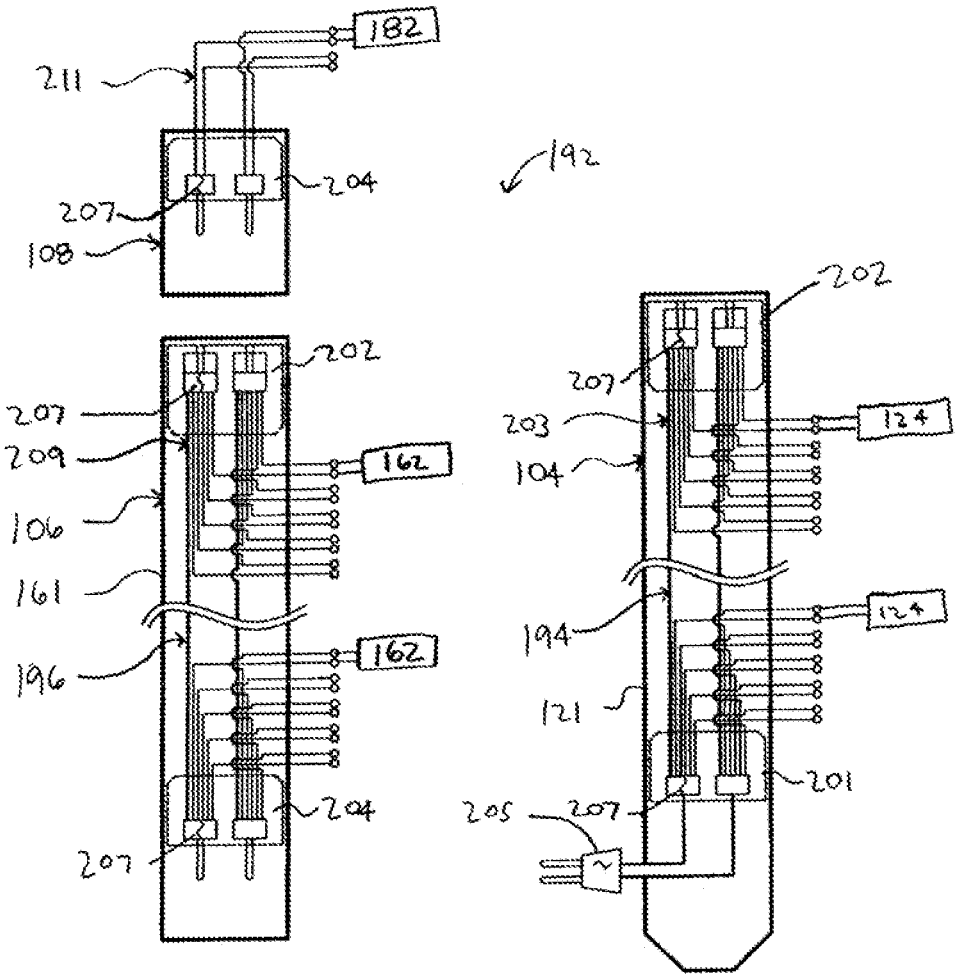
FIG. 3 depicts an electrical connector and wiring assembly of the tree of FIG. 1, according to an embodiment of the claimed invention.

Referring to FIG. 3, in this embodiment, electrical connection and wiring assembly 192 of tree 100 is depicted. Electrical connection and wiring system 192, in an embodiment, includes three electrical connection and wiring harness assemblies 194, 196, and 198 for the respective tree 100 tree sections 104, 106, and 108.

Electrical connection and wiring harness assembly 194 includes electrical connector 201, electrical connector 202, wiring 203 and power cord 205.

Each electrical connector 201 and 202 is configured to fit partially or fully within trunk portion 121. Electrical connectors 201 and 202 will be described further below in detail.

In an embodiment, each connector 201 and 201 includes a fuse 207. Multiple light sets 124 may be connected to electrical connection and wiring harness assembly 194. In the embodiment depicted, each light set 124 has an electrical connection at one end to one electrical polarity, and another electrical connection to a second electrical polarity.

Electrical connection and wiring harness assembly 196 is similar to assembly 194, and includes electrical connector 202, electrical connector 204, and wiring 209.

Each electrical connector 202 and 204 is configured to fit partially or fully within trunk portion 161. Electrical connectors 202 and 204 will be described further below in detail.

Multiple light sets 162, which may substantially similar to light sets 124, may be connected to electrical connection and wiring harness assembly 196.

Electrical connection and wiring harness 198, in an embodiment, includes electrical connector 204 and wiring 211. Harness 198 is electrically connected to light strings 182.

When assembled, power is distributed throughout assembly 192 and to connected light strings 124, 162, and 182.

Additional embodiments of electrical connection and wiring harnesses of the claimed invention are also described and depicted in U.S. Pub. No. 2012/0076957, which is herein incorporated by reference in its entirety.

Figure 6:
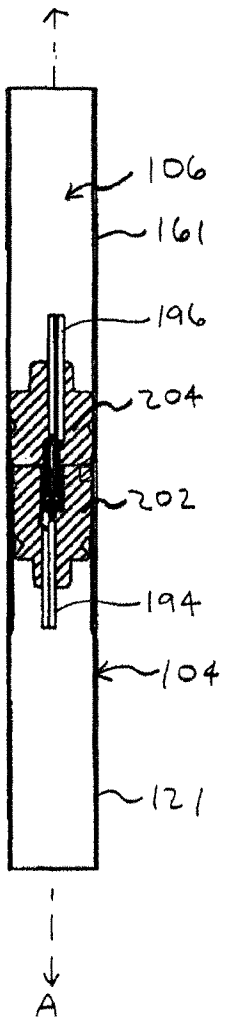
FIG. 6 depicts a cross section of the first and second tree portions of FIG. 4.
Figure 5:
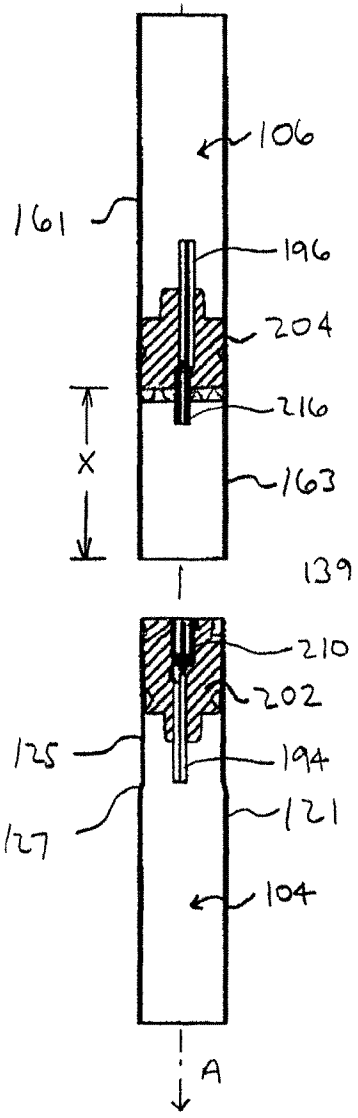
FIG. 5 depicts a cross section of the first and second tree portions of FIG. 4, in an uncoupled position.
Figure 4:
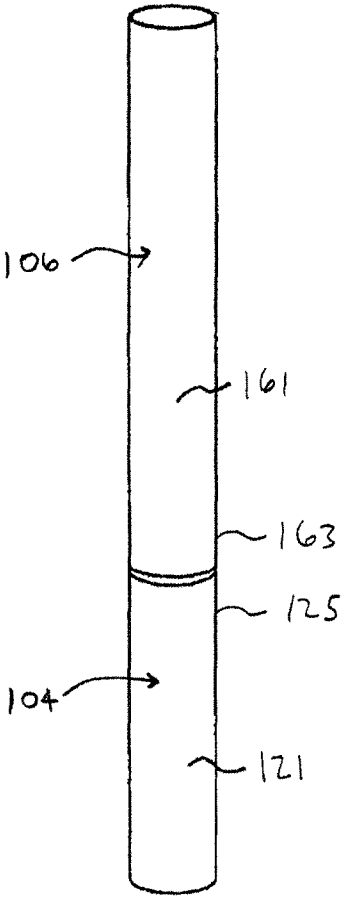
FIG. 4 depicts a first tree portion of the tree of FIG. 1 coupled to a second tree portion of the tree of FIG. 1.

Referring to FIGS. 4-6, tree portion 104 is mechanically and electrically coupled to tree portion 106, both mechanically and electrically.

Referring specifically to FIG. 4, trunk portion 161 of tree portion 106 is coupled to trunk portion 121 of tree portion 104. In an embodiment, and as depicted first end 163 of trunk portion 161 has an inside diameter the same as, or slightly smaller than, second end 125 of trunk portion 121, such that trunk 161 at end 163 fits over, or receives, second end 125 of trunk portion 121, thusly forming a mechanical coupling or connection between trunk portions 121 and 161, and of tree portions 104 and 106.

Referring to FIG. 5, a cross section of end 125 of tree portion 104 uncoupled from end 163 of tree portion 106 is depicted. In an embodiment, electrical connector 202 is inserted fully into trunk portion 121 at end 125, such that an end of electrical connector 202 is even with, or flush with, an opening into trunk portion 121 at end 125. In other embodiments, electrical connector 202 may be inserted further into trunk portion 121, and further from the opening of trunk portion 121. In other embodiments, portions of electrical connector 202 may extend outside trunk portion 121, such as an electrical terminal or connector.

Electrical connector 204 is inserted into trunk portion 161. In an embodiment, electrical connector 204 is located a distance X from an end opening 139 of trunk portion 161. In an embodiment, distance X also approximately corresponds to the length or amount of trunk portion 161 that overlaps with trunk portion 121. Though not restricted to any particular range, in an embodiment, distance X may range from zero to 8 inches, depending on the desired overlap of trunk portions 121 and 161, and the relative position of electrical connector 202 in trunk portion 121. In general, electrical connector 204 should be positioned within trunk portion 161 such that when trunk portion 161 is fully coupled to trunk portion 121, electrical connectors 204 and 202 are adjacent one another, and in electrical connection with one another, as depicted in FIG. 6.

Prior to coupling tree portion s 104 and 106, trunk portions 121 and 161 are aligned along axis A. In an embodiment, trunk portions 121 and 161 define a circular cross-section, such that the trunk portions may be aligned in any rotational orientation or alignment, about axis A. To couple tree portions 104 and 106, the tree portions are moved relative to one another along axis A, such that end 125 is received by end 163. When end 163 initially receives end 125, such that trunk portions 121 and 161 are not fully coupled, which in an embodiment means that a distal end of end 163 of trunk portion 161 is not yet seated against shoulder 127 of trunk portion 121, electrical connector 204 is also not yet mechanically or electrically coupled to electrical connector 202.

As ends 125 and 163 are moved relatively along axis A, in an embodiment, only axial and rotational movement along axis A is possible. In other words, a user is substantially unable to tilt one of tree portions 104 and 106 off of axis A. If a user does exert a force transverse to axis A onto one of tree portions 104 and 106, trunk portions 121 and 161, which in an embodiment comprise a stiff metal material, will generally be unyielding. As end 163 is moved onto end 125, connectors 204 and 202 are in axial alignment, but not yet in contact. As such, trunk portions 121 and 161 are initially coupled and aligned prior to the coupling of electrical connectors 204 and 202. In an embodiment, electrical connectors 204 and 202 may be coupled in one of many rotational alignments.

Such an arrangement ensures that when electrical connectors 204 and 202 make initial contact, only axial and in some cases, rotational, movement is allowed, and the connectors are aligned. Conversely, if one of tree portions 104 or 106 is allowed to move transversely to axis A when electrical connector 204 is not fully coupled to electrical connector 202, damage to the electrical connectors could result. This feature becomes more important to those connectors, such as electrical connector 204, which have electrical contacts or terminals extending outwardly from the connector body portion that may be bent or otherwise damaged upon receiving a force transverse to axis A.

Referring to FIG. 6, trunk portion 121 is mechanically coupled to trunk portion 161, and electrical connector 202 is coupled to electrical connector 204. Trunk portion 121 at end 125 is received by trunk portion 161 at end 163 and is fully seated. Electrical connectors 204 and 202 are coupled together such that an end of connector 204 is adjacent an end of connector 202. Details of electrical connectors 204 and 202, and of their electrical connection, are described further below, including with respect to FIGS. 7-16.

Referring also to FIGS. 7-16, an embodiment of electrical connection system 200 that includes electrical connector 204 and electrical connector 202, is depicted. In the depicted embodiment, system 200 comprises a coaxial electrical trunk-connection system having a rotation-lock feature to prevent rotation about an axis A of one electrical connector with respect to the other.

System 200 may be used for an alternating-current (AC) powered tree 100 or a direct-current (DC) powered tree 100. In some applications, it may be preferable to apply system 200 to a relatively low-power AC tree 100, or a DC tree 100.

Figures 7, 8, 9, 10, 11, 12, 13, 14, 15, 16:
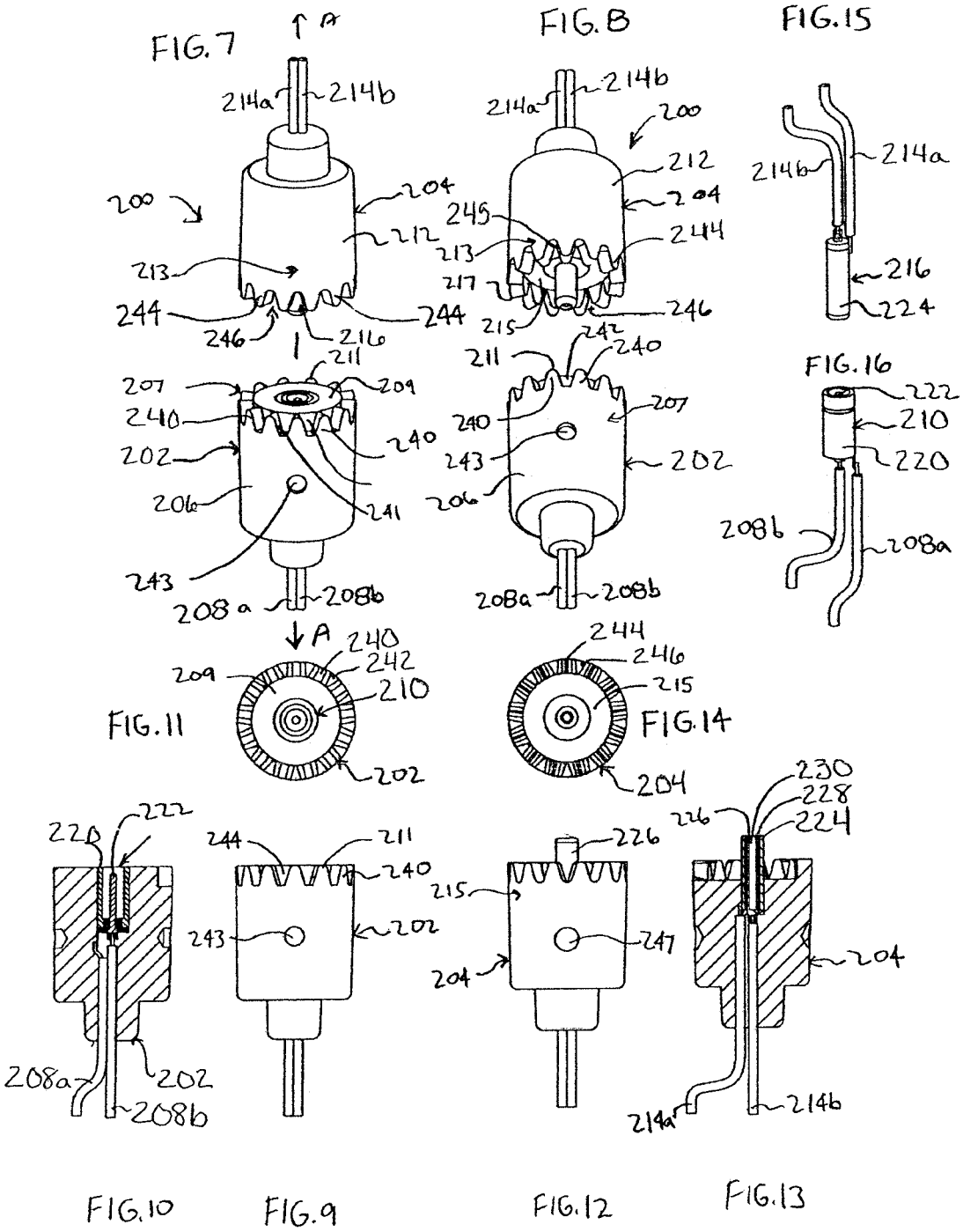
FIGS. 7-16 depict a rotation-lock electrical connector system of the tree of FIG. 1, according to an embodiment of the claimed invention.

Referring to FIGS. 7 and 8, system 200 includes first electrical connector 202 and second electrical connector 204. In an embodiment, first electrical connector 202 is configured to couple with, and receive, a portion of second electrical connector 204 such that an electrical connection between the two connectors is made.

Referring also to FIGS. 9-11, first electrical connector 202, which in an embodiment comprises a female connector, includes body 206, wires 208*a* and 208*b* of wiring harness 194, and first electrical contact set 210.

Referring to FIGS. 12-14, second electrical connector 204 includes body 212, wires 214*a* and 214*b* of wiring harness 196, and second contact set 216.

Referring to FIG. 15, contact set 210 for female electrical connector 202 is depicted. Referring also to FIG. 10, contact set 210 includes first-electrical-polarity contact 220 and second-electrical-polarity contact 222. In an embodiment, first-polarity-contact 220 comprises a cylindrical electrical, conductive contact, with at least a conductive surface on an inside of the contact. In an embodiment, second-polarity-contact 222 comprises a pin-like structure with a conductive outer surface. Second-polarity-contact 222 projects upward through the center of the cylindrical cavity formed by first-electrical-polarity contact 220.

Referring to FIG. 15, contact set 216 of second electrical connector 204 is depicted. Referring also to FIG. 13, contact set 216 includes a first-electrical-polarity contact 224 and second-electrical-polarity contact 226. In an embodiment, both first-electrical-polarity contact 224 and second form a generally cylindrical shape, with contact 226 forming a generally smaller diameter cylindrical shape, and fitting within contact 224. A layer of insulating material 228 is adjacent contact 224 and contact 226 to prevent electrical conduction between the two contacts. Second-electrical-polarity contact 226 defines cylindrical receiver 230.

Referring also to FIG. 6, when female electrical connector 202 is coupled to second electrical connector 204, contact set 210 is coupled to contact set 216, such that contact 220 is in contact with contact 224; contact 222 is in contact with contact 226.

As such, in this particular embodiment, electrical contract set 216 and electrical contact set 222 are coaxial about axis A. Pin contact 222 is centrally positioned along axis A, cylindrical contact 226 is in electrical contact with, and generally surrounding contact 222, such that it is coaxial with contact 222 about axis A. Further, outer surface of contact 224 is adjacent and in electrical contact with contact 220. Both are generally cylindrical, concentric to one another, and coaxial about axis A.

In other embodiments, contact sets 216 and 222 are not coaxial, or only portions of contact sets 216 and 222 are coaxial.

In addition to forming an electrical connection between female electrical connector 202 and second electrical connector 204 when the two connectors are coupled, an anti-rotational coupling is also accomplished. This anti-rotation or anti-twist feature is due to the use of rotation-lock bodies 206 and 212, such that electrical connectors 202 and 204 comprise rotation-lock electrical connectors.

In an embodiment, body 206 of first electrical connector 202 includes a plurality of projections or engagement portions 240, which may comprise projections or teeth 240, and define a plurality of recesses or gaps 242 between each projection 240. Body 206 also includes first end 207 defining first-end surface 209, and in an embodiment, defines locating recess 243. Locating recess 243 may be used to locate body 206 within trunk portion 121 so as to secure body 206 within trunk 121. In an embodiment, recess 243 may be paired with a projection or pin projecting radially into trunk 121, thereby securing body 206 in trunk portion 121.

In an embodiment, projections 240 are distributed circumferentially about a perimeter of first end 207 of body 206. In another embodiment, projections 240 are inset towards a center of body 206, rather than being located at an outside edge of first end 207. In an embodiment, projections 240 do not extend axially beyond first-end surface 209, and in an embodiment, projections 240 may be distributed equidistantly.

As depicted, each projection 240 includes angled sides 241, and forms a tip 211. In embodiments, tips 211 may be pointed or rounded. In such an embodiment, and as will be described further below with respect to FIGS. 18A-18C, generally non-planar tips 211 may facilitate the final alignment of connectors 202 and 204.

In an embodiment, body 212 of second electrical connector 204 includes a plurality of engagement portions 244 or projections 244, and defines a plurality of gaps or recesses 246 between each tooth or projection 244, and in an embodiment, may include locating recess 247. Body 212 in an embodiment also includes second end 213 and second-end surface 215. In an embodiment, projections 244 are distributed circumferentially about a perimeter of first end 213 of body 212. In another embodiment, projections 244 are inset towards a center of body 212, rather than being located at an outside edge of first end 207. In an embodiment, projections 244 do not extend axially beyond first-end surface 215, and in an embodiment, projections 244 may be distributed equidistantly.

As depicted, each projection 244 includes angled sides 245, and forms a tip 217. In embodiments, tips 217 may be pointed or rounded. In such an embodiment, and as will be described further below with respect to FIGS. 18A-18C, generally non-planar tips 217 may facilitate the final alignment of connectors 202 and 204.

When first electrical connector 202 is coupled to second electrical connector 204, each tooth or projection 240 of first electrical connector 202 fits into a recess 246 of second electrical connector 204. Similarly, each projection 244 of second electrical connector 204 fits into a recess 242 of first electrical connector 202.

Figure 17:
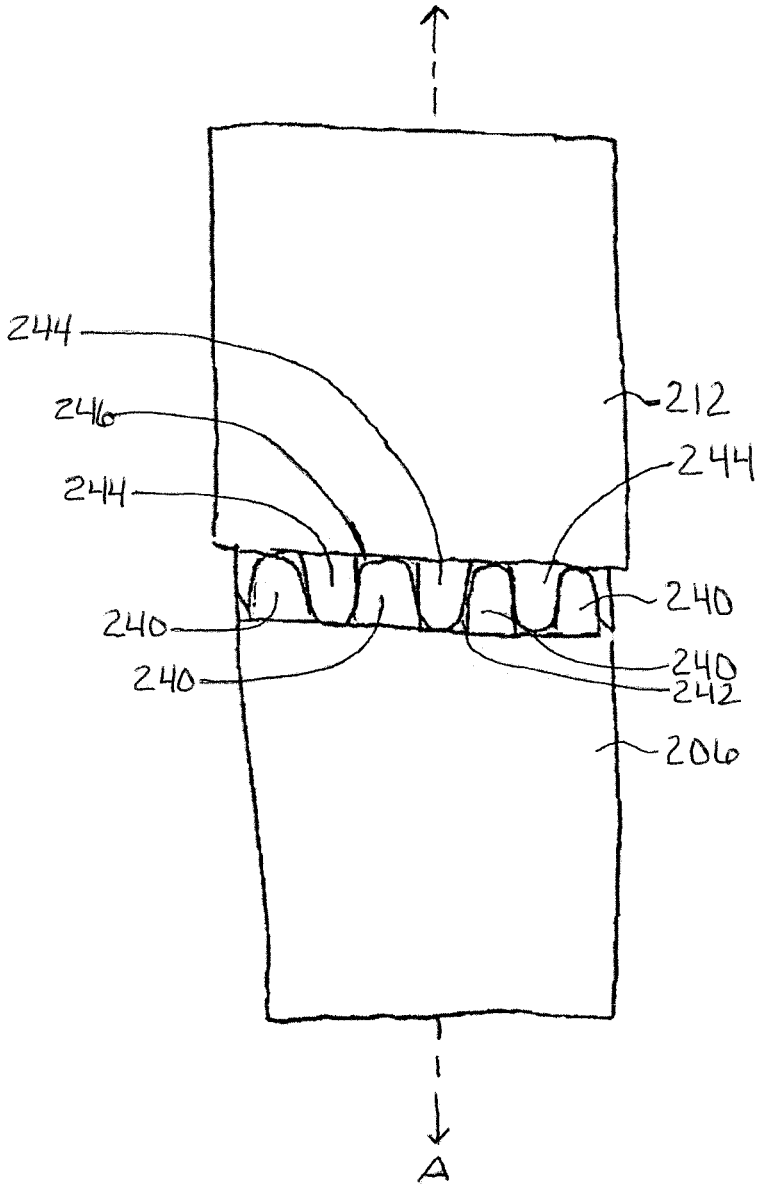
FIG. 17 depicts a first electrical connector body coupled to a second electrical connector body.

Referring also to FIG. 17, body 206 is depicted as coupled to body 212. When tree portions 104 and 106 are joined together and fully coupled, body 206 interlocks with body 212.

When connectors 202 and 204 are held securely in their respective trunk portions, and the trunk portions are coupled together, connector 202 generally cannot rotate relative to connector 204, unless an axial force is applied to one or the other of the connectors. In other words, when first electrical connector 202 and second electrical connector 204 are aligned along axis A as depicted, and when coupled together in a final engagement position, the connectors are generally not able to rotate relative to one another about Axis A.

Figure 18A:
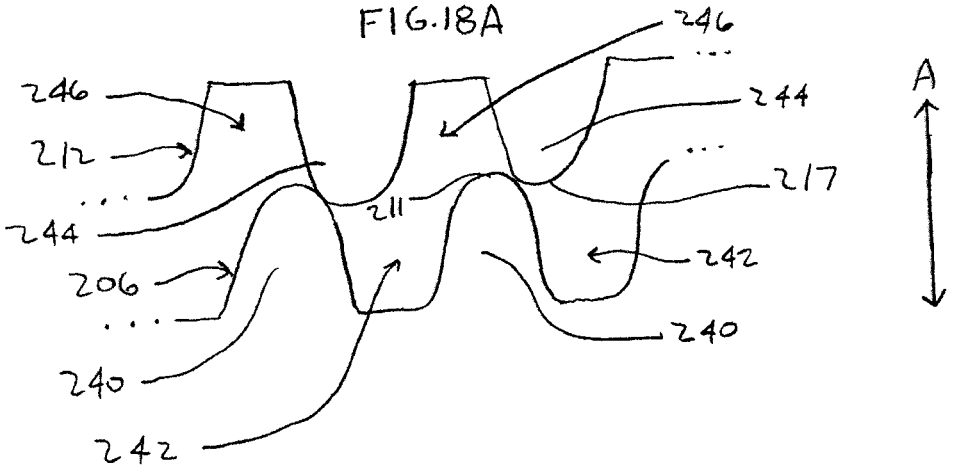
FIG. 18A depicts a portion of a first electrical connector body initially engaging with a portion of a second electrical connector body, prior to a final engagement position.
Figure 18B:
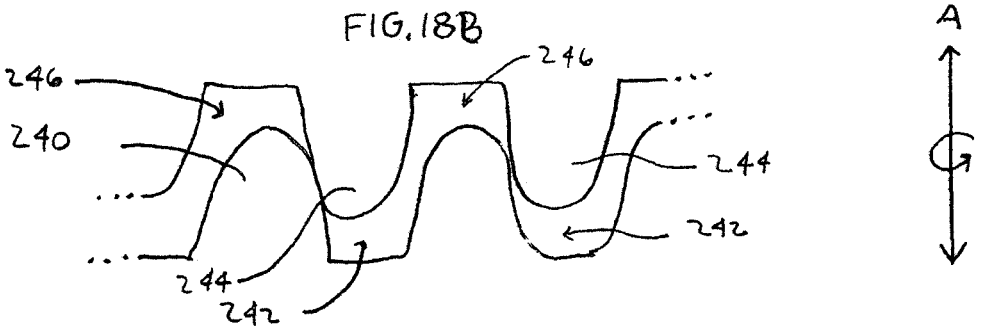
FIG. 18B depicts the portions of FIG. 18B in a second, intermediate engagement position.
Figure 18C:
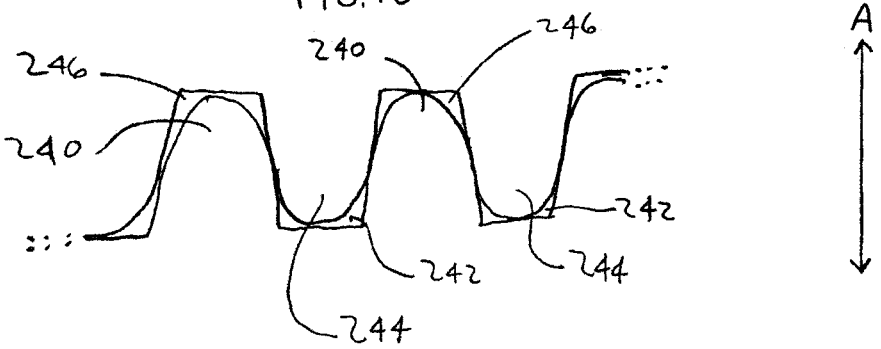
FIG. 18C depicts the portions of FIG. 18A engaged in a final engagement position.
Figures 73, 74, 75, 76, 77, 78, 79, 80, 81, 82:
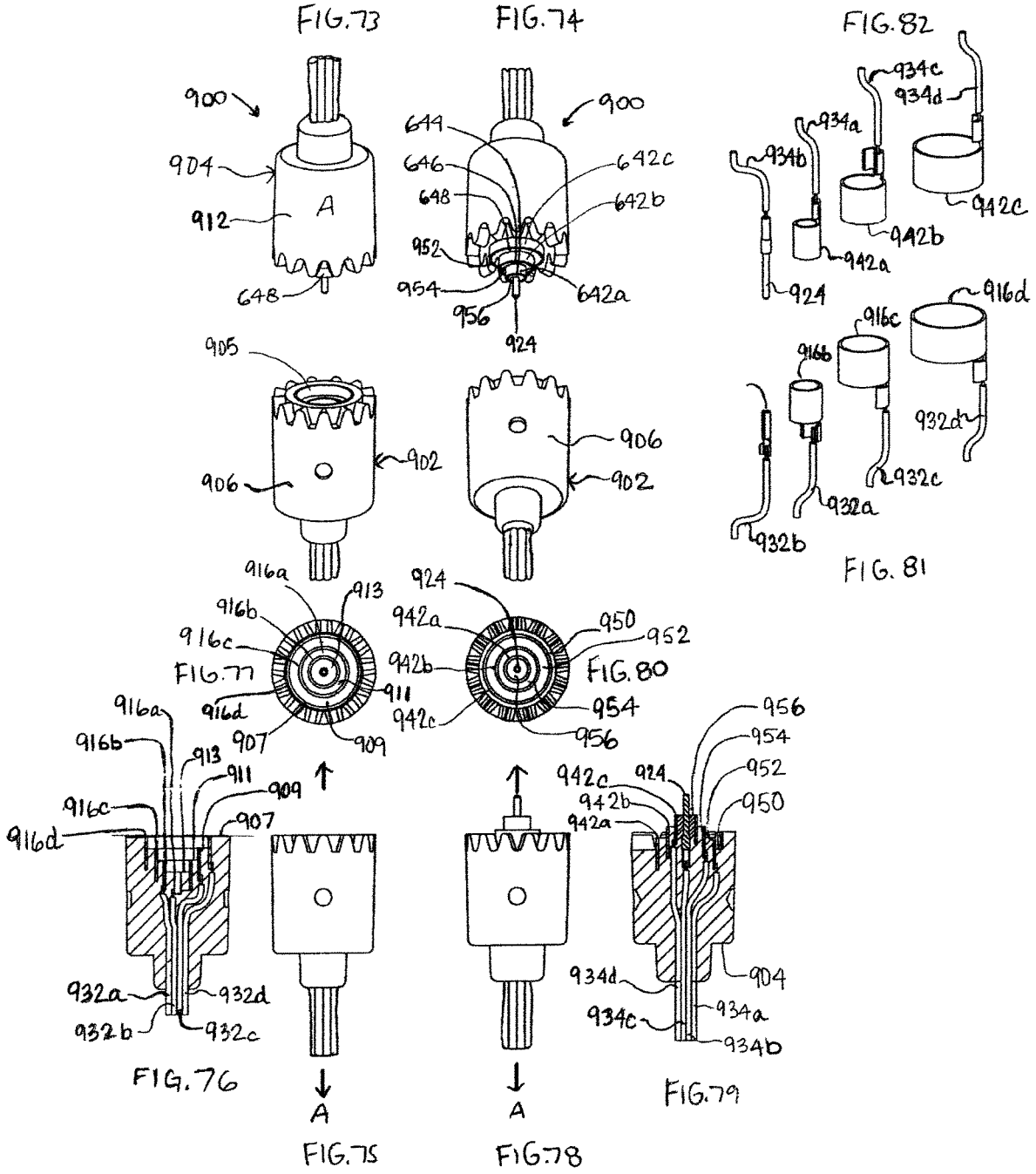
FIGS. 73-82 depict a tiered rotation-lock electrical connector system having a four-pole electrical contact set, according to an embodiment of the claimed invention.

Referring to FIGS. 18A-18C, portions of body 212 and body 206 of electrical connections 204 and 202, respectively, are depicted. Body portion 212 is positioned axially along axis A adjacent body 206, with projections 240 and 244 coming into contact, resulting in body 212 being rotated slightly about axis A, and therefore into alignment with body 206.

Referring specifically to FIG. 18A, body 212 has been moved along axis A such that projections 244 are not aligned with gaps or recesses 242 of body 206, and body 212 is in a first or initial contact position with respect to body 206. Projections 244 are in contact with projections 242, such that tips 211 generally adjacent and near tips 217 and/or angled sides 241 may be in contact with angled sides 245. Such an alignment (or misalignment with respect to a final position) may occur when tree portions 104 and 106 are in the process of being coupled together, such as when a user lowers end 163 of tree portion 106 over end 125 of tree portion 104, and connectors 202 and 204 make initial contact.

Referring to FIG. 18B, body 212 is depicted in a second position. More specifically, body 212 has been rotated slightly about axis A, as indicated by the arrow. Such a rotation and change from the initial position of FIG. 18A to the second position of FIG. 18B, may occur without user intervention. The weight of tree portion 106, which carries electrical connector 204 and its corresponding body 212 causes body 212 to apply a downward force onto body 206.

In an embodiment, tips 211 and 217 of bodies 206 and 212 may be rounded or pointed, or generally non-planar (not defining a plane perpendicular to axis A at the tip). In such an embodiment, tips 211 and 217 make contact along a sloped surface, such that the weight of tree portion 106 creates a torsional force on body 212, causing it to rotate about axis A. In other embodiments, tips 211 and 217 may comprise planar tip surfaces, but in such embodiments, it may be possible for bodies 206 and 212 to make initial contact, then only make final contact with user intervention, i.e., an external rotational force or torque being applied to one or the other tree portion.

Of course, rotation only occurs if the torsional force or torque on body 212 is great enough to overcome the frictional forces between body 212 and body 206. In an embodiment, projections 240 and 244 comprise relatively smooth contact surfaces, and may comprise a non-conductive plastic material, such that the static friction between bodies 212 and 206 is relatively small. In such embodiments, the weight of tree portion 106 and the subsequent applied torque causes body 212, which is held stationary in tree portion 106, to rotate along with tree portion 106 about axis A.

Referring to FIG. 18C, body 212 has rotated about axis A, and moved axially along axis A to a final alignment or coupling position.

As such, the rotation-lock structural features of electrical connectors 202 and 204, in certain embodiments, also provide a self-aligning feature. As such, a user may initially align and partially couple second trunk portion 161 of tree portion 106 with first trunk portion 121 of first tree portion 104 along axis A, and at any rotational alignment position. As the trunk portions are brought together, bodies 212 and 206 will self align under the weight of tree portion 106, such that body 212 is coupled with body 206 in one of a number of predetermined, discrete rotational alignment positions. The number of possible alignment positions is dependent upon the number of projections and recesses. In the depicted embodiment of FIGS. 7-16, thirteen projections 244 fit into thirteen recesses 246, such that thirteen alignment positions are possible. The number of rotational orientation or alignment positions may be fewer or greater.

As such, connectors 202 and 204 may be coupled in any one of a plurality of rotational positions relative to one another, but once they are coupled, the connectors cannot easily rotate. Such a feature allows a user to easily assemble one tree section to another tree section without having to be concerned with a rotational alignment of the two tree sections. At the same time, once the tree sections are joined, the tree sections will not rotate in the absence of an axial force, which provides both safety and aesthetic advantages.

Referring to FIGS. 19-26, another embodiment of a rotation-lock electrical connection system is depicted, system 300. System 300 is substantially the same as system 200, though the rotation-lock features vary.

Rotation-lock electrical connection system 300 includes first electrical connector 302 and second electrical connector 304, which when coupled together substantially are unable to rotate relative to one another in the absence of an axial force. First electrical connector 302 is substantially similar to first electrical connector 202, and second electrical connector 304 is substantially similar to second electrical connector 204.

Body 312 of second electrical connector 304 comprises a plurality of pyramidal engagement portions/projections or projecting teeth 320. Body 306 of first electrical connector 304 defines a plurality of receiving recesses 322. When connectors 302 and 304 are coupled together, each projection 320 fits into a corresponding recess 322. To facilitate alignment of projections 320 and recesses 322, projections and recesses are angled such that when one connector is moved toward another along an axis A, the connectors may rotate slightly as the bodies 306 and 312 are joined together (similar to the rotation described above with respect to FIGS. 18A-18C). Once fully coupled, connector 302 is generally unable to rotate about connector 304.

Referring to FIGS. 27 to 34, another embodiment of a rotation-lock electrical connection system, system 400 is depicted. System 400 is substantially the same as system 300, with the exception of variations in the rotation-lock feature. System 400 includes dome-shaped projections 420 that fit into dome-receiving recesses 422. Domed projections 420 do not include any sharp angles, and are less likely to bind or stick when connector 402 is coupled to connector 404 and domes 420 are inserted into recesses 422.

Referring to FIGS. 35 to 42, another embodiment of a rotation-lock electrical connection system, system 500 is depicted. System 500 is similar to systems 200, 300, and 400, with the exception of variations in the rotation-lock feature.

Body 506 of first electrical connector 502 comprises axially-projecting portion 520, ridges 522, and circumferential ledge 524. Ridges 522 are spaced about projecting portion 520, extending axially along projecting portion 20, and projecting radially away from ledge 524. Ridges 522 define gaps 525 between ridges 522. In an embodiment, ridges 522 are equidistantly spaced.

Body 512 of second electrical connector 506 includes projecting wall 526 which includes axially extending and radially-projecting ridges 528, and which defines cavity 530. Ridges 528 extend along wall 526.

When body 506 is coupled to body 512, projecting portion 520 is received by cavity 530. Ridges 522 fit between ridges 528, such that each ridge 522 is adjacent a pair of ridges 528. Ridges 522 fit into gaps 529, while ridges 528 fit into gaps 525.

In this embodiment, first electrical connector 502 can couple with electrical connector 504 in a plurality, but limited number of positions, dependent on the number of ridges 522 and 528. As depicted, body 506 and body 512 each include twelve ridges, such that body 506 and body 512 may be coupled in twelve different rotational orientations.

However, within each rotational orientation, body 506 and body 512 may be able to move rotationally relative to one another, but in a limited way. Movement is restricted based on contact of ridges 522 with ridges 528.

Referring to FIGS. 43 to 52, an embodiment of rotation-lock electrical connection system 600 is depicted. Each rotation-lock electrical connection system includes first contact set 610 and second contact set 616. Although system 600 may be used with any electrical power source, including AC or DC, these systems may be especially suited for use with AC power due, at least in part, to the greater distance between electrical contacts, or terminals.

System 600 is substantially similar to system 200 depicted in FIGS. 7-16, with the exception of the contact sets, how they are fitted into the insulating body parts, and how they contact each other.

System 600 includes first contact set 610 and second contact set 616. First contact set 610 may in some embodiments resemble a first contact set adapted to, or configured to, receive a male counterpart electrical contact set. Second contact set 616 may in some embodiments resemble a male contact set adapted to, or configured to, be received by a first counterpart electrical contact set.

Contact set 610 includes first electrical contact or terminal 610*a* and second electrical contact or terminal 610*b*. First contact 610*a* includes ring portion 618 having an inner surface 620 and outer surface 622. Ring portion 618 may be circular or ring-shaped, and may be contiguous, as depicted. In other embodiments, ring portion 618 may form a polygon when viewed in cross-section along a vertical axis A.

Second contact 610*b* also includes a ring portion, ring portion 623, though having a smaller diameter relative to its length, as compared to ring portion 618. In an embodiment, ring portion 630 may not be circumferentially contiguous, but may define slot 632, such that ring portion 630 may expand when a corresponding male contact is inserted.

Second electrical contact set 616 includes first contact 616*a* and second contact 616*b*. Second contact 616*b*, in an embodiment, defines a generally cylindrical shape. First contact 616*a* includes spade portion 624. Spade portion 624 includes inside surface 626 and outside surface 628. In an embodiment, inside surface 626 defines a flat, planar surface, while outside surface 628 defines an arcuate surface.

First contact set 610 is assembled into body 606 of first electrical connector 602 as depicted. Outside surface 622 of first contact 610*a* may be adjacent to, and in contact with a wall or surface of body 606. Body 606 defines an annular, ring-like, or circular channel 634.

Second contact set 616 is assembled into body 612, with portions of each of contact projecting outward and away from body 612. Second contact 616*b* is generally centrally located, while first contact 616*a* is offset from the center of body 612.

When first/female electrical connector 602 is coupled to second/male electrical connector 604, second contact 610*b* receives second contact 616*b*, thereby making an electrical connection between the two contacts. First contact 616*a* is received by channel 634 and surface 628 contacts first contact 610*a* at surface 620, thereby making an electrical connection between the two contacts.

Similar to the previously defined systems, electrical contact set 610 may make electrical connection with set 616 in any rotational orientation or alignment, though the rotational alignment or position may be restricted by the discrete number of alignments possible between bodies 606 and 612.

In this embodiment, contacts 610*b* and 616*b* are coaxial, while connectors 610*a* and 616*a* are not coaxial. Contact 610*a* is coaxial with 610*b* and 616*b*.

Connector 602 may be coupled to connector 604 in any one of a plurality of discrete or predetermined rotational alignments or positions.

When connector 602 is coupled to connector 604, portions of bodies 606 and 612 serve to electrical insulate the electrical contacts such that the possibility of arcing between contacts, or accidental shorting, is minimized.

In other embodiments, system 600 may substitute other bodies, such as those described above, and including bodies 306/312 (pyramidal projections), 406/412 (domed projections), 506/512 (ridges), or other rotation-lock bodies having other forms of projections and recesses.

Referring to FIGS. 53 to 62, an embodiment of system 700 is depicted. System 700 is substantially similar to system 200 depicted in FIGS. 7-16, with the exception of the contact sets, how they are fitted into the insulating body parts, and how they contact each other. System 700 is also similar to system 600, again, with the exception of the contact sets.

System 700 includes first contact set 710 having contacts 710*a* and 710*b*, and second contact set 716, having contacts 716*a* and 716*b*.

In an embodiment, contacts 716*a* and 716*b* are substantially the same, and substantially similar to contact 616*a* described above. In an embodiment, contact 710*a* is substantially similar to contact 610*a* described above. Contact 710*b* may be substantially similar to contact 710*a*, only smaller in diameter.

When assembled into body 706, contact 710*a* and 710*b* are generally coaxially aligned.

When assembled into body 712, contact 716*a* is offset from a center of body 712; contact 716*b* is also offset from center, but is closer to center.

When first electrical connector 702 is coupled to second electrical connector 704, contact 710*a* is adjacent contact 716*a*, forming an electrical connection. Contact 716*a* is received by annular channel 734. Contact 710*b* is adjacent contact 716*b*, also forming an electrical connection. Contact 716*b* is received by center cavity 736. Connector 702 may be coupled to second connector 704 in any one of a plurality of circumferentially-locked positions.

In other embodiments, system 700 may substitute other bodies, such as those described above, and including bodies 306/312 (pyramidal projections), 406/412 (domed projections), 506/512 (ridges), or other rotation-lock bodies having other forms of projections and recesses.

Referring to FIGS. 63 to 72, an embodiment of system 800 is depicted. System 800 is similar to systems 600 and 700, sets, but with somewhat different bodies and contact sets. Body 812 includes central projection 1320 which projects axially outward and away from an inner surface 823, and that defines generally-planar top surface 821.

Body 806 defines top surface 825, inner surface 827, and defines central cavity 822.

System 800 includes contact set 810 comprising two concentric, conducting electrical contacts 810*a* and 810*b*, both of which comprise annular, ring-like, or cylindrical contacts. Contact 810*b* includes a smaller diameter than contact 810*a*. Contacts 810*a* and 810*b* are located in body 806. In an embodiment, terminal 810*b* extends axially along a central axis and at or below inner surface 827 in an interior of body 806. Contact 810*a* is coaxial to contact 810*b* and in an embodiment does not extend axially above a plane formed by surface 825.

System 800 also includes contact set 816, comprising pin terminal 816*b* and ring contact 816*a*. Contact 816*b* when attached to body 812 is aligned along a central axis of body 812. Contact 816*a* is placed over projection portion 820 of body 812, such that at least a portion of contact 816*a* projects axially away from surface 823.

In the depicted embodiment, all four contacts are coaxial about a central axis.

When body 806 is coupled to body 812, projection 820 and terminal 816*a* are received by cavity 822, thus providing another mechanical connection between bodies 1306 and 1312. Surface 827 may contact surface 821, and surface 825 may contact surface 823. Contact 816*a* is in electrical connection with contact 810*a*; contact 810*b* is in electrical connection with contact 810*a*.

In such an embodiment, an inner and outer mechanical coupling of bodies 806 and 812 are accomplished to improve the mechanical connection between electrical connectors 802 and 804. Further, the use of multiple ring or cylindrical electrical contacts improves the surface area contact between electrical contacts, while maximizing the distance between contacts of dissimilar polarity, thereby reducing the possibility of arcing or accidental shorting.

Additionally, for each connector 802 and 804, portions of insulating bodies 802 and 806 lie between the contacts, again, reducing the possibility of arcing or shorting between electrical contacts. More specifically, and referring to FIG. 66, a plane formed by inner surface 827 that is generally perpendicular to a central axis A intersects, or is transverse to contact 810, but generally does not intersect contact 810*b*, which lies at or below surface 827. Such an arrangement allows body material 829 to be located between terminals 810*a* and 810*b*. A similar structure is present in connector 804, as depicted in FIG. 69.

In other embodiments, system 800 may substitute other bodies, such as those described above, and including bodies 306/312 (pyramidal projections), 406/412 (domed projections), 506/512 (ridges), or other rotation-lock bodies having other forms of projections and recesses.

Referring to FIGS. 73-82, a tiered electrical connector system 900 is depicted. In an embodiment, and as depicted, system 900 is configured to connect to four-wire wiring harnesses and subassemblies, though it will be understood that system 900 could be configured to have additional electrical terminals to connect with wiring harnesses having more than four wires.

In an embodiment, system 900 includes tiered electrical connector 902 and tiered electrical connector 904.

Tiered electrical connector 902 comprises body 906 and cylindrical or band-like electrical terminal set 916, including terminals 916*a*, 916*b*, 916*c*, and 916*d*. Tiered electrical connector 902 also defines a tiered cavity 905.

Body 906 defines top, generally planar annular surface 907, and a plurality of tiered, generally planar and annular surfaces within tiered cavity 905. Tiered surfaces within cavity 905 include surface 907, 909, 911, and 913. Surfaces 907, 909, 911, and 913 form decreasingly smaller annular rings as a center of connector 902 is approached. Further, planes formed by surfaces 907, 909, 911, and 913, in an embodiment, are generally parallel.

Terminal set 916 comprises the set of concentrically arranged cylindrical electrical terminals 916*a*, 916*b*, 916*c*, and 916*d*, each having an increasingly larger diameter, and connected to wires 932*a*, 932*b*, 932*c*, and 932*d*, respectively. In an embodiment, central terminal 916*a* is a first polarity, e.g., neutral, and terminals 916*b*, *c*, and *d* comprise a second polarity, e.g., positive, "live" or "hot". In another embodiment, two terminals comprise a first polarity, and two terminals comprise a second polarity.

Tiered electrical connector 904 comprises body 906, electrical terminal 924, and cylindrical terminal set 942 comprising electrical terminals 942*a*, 942*b*, and 942*c*.

Tiered body 906 forms first tier 944, second tier 946 and third tier 948. Tiered body 906 and its respective tiers also define annular surfaces 950, 952, 954 and 956. In an embodiment, third tier 948 is furthest from surface 950; second their 946 is second furthest from surface 950; and first tier is closest to surface 950. In an embodiment, each tier has approximately the same tier height, defined as a vertical distance from a plane of one tier to a plane of an adjacent tier.

Terminal set 942 comprises the set of concentrically arranged cylindrical electrical terminals 942*a*, 942*b*, and 942*c* each having an increasingly larger diameter, and connected to wires 932*b*, 932*c*, and 932*d*, respectively. In an embodiment, central terminal 924 is a first polarity, e.g., neutral, and terminals 934*a, b*, and *c* comprise a second polarity, e.g., positive, "live" or "hot". In another embodiment, two terminals comprise a first polarity, and two terminals comprise a second polarity.

When electrical connector 902 of system 900 is coupled with electrical connector 904, tiered cavity 905 receives a portion of electrical connector 904, including tiers 944, 946, and 948 and portions of their respective electrical terminals 942*a*, 942*b*, and 942*c*. In an embodiment, surfaces 950, 952, 954, and 956 of electrical connector 904 are adjacent, and in some embodiments, in contact with, surfaces 907, 909, 911 and 913, respectively, of electrical connector 902. As such, a secure mechanical fit is formed between electrical connector 902 and electrical connector 904.

A safe electrical connection is also made between connectors 902 and 904. Terminal 916*a* receives terminal 924, making an electrical connection between the two terminals and between their respective wires 932*b* and 934*b*.

Further, an outside surface of terminal 942*a* contacts in inside surface of terminal 916*b* to make an electrical connection between wires 932*a* and 934*a*; an outside surface of terminal 942*b* contacts in inside surface of terminal 916*c* to make an electrical connection between wires 932*c* and 934*c*; and an outside surface of terminal 942*c* contacts in inside surface of terminal 916*d* to make an electrical connection between wires 932*d* and 934*d*. In an embodiment, each of terminals 924, 942*a*, 942*b*, and 942*c* have outside diameters that are approximately the same size as their corresponding mating terminals 916*a*, 916*b*, 916*c*, and 916*d*, respectively such that each terminal pair makes surface contact as described above.

The connection of the terminal sets results in electrical connection between the respective wire sets 932 and 934, such that power may be provided from one tree portion to another.

Consequently, not only does the coupling of tiered electrical connectors 902 and 904 result in a superior mechanical connection, electrical connections between multiple pairs of electrical terminals within a relatively small space is made with minimal risk of arcing between terminals of disparate polarity.

In other embodiments, system 900 may substitute other bodies, such as those described above, and including bodies 306/312 (pyramidal projections), 406/412 (domed projections), 506/512 (ridges), or other rotation-lock bodies having other forms of projections and recesses.

In one such embodiment, and referring to FIGS. 83-90, system 1000 having bodies with pyramidal projections is depicted. System 1000 is substantially similar to system 900, with the exception of bodies 1006 and 1012 which are similar to bodies 306 and 312, but tiered.

System 1000 includes electrical connectors 1002 and 1004, similar to connectors 902 and 904, respectively. Electrical connector 1002 includes locking body 1006 and contact set 1016 (similar to contact set 916, though with smaller concentric rings to accommodate the projections). Locking body 1006 includes pyramidal projections 320 that fit into recesses 322 of locking body 1012. Electrical connector 1004 includes locking body 1012 and contact set 1042 (similar to contact set 942, though with smaller concentric rings to accommodate recesses 322). Locking body 1012 includes recesses 322.

Embodiments of the claimed invention may also include methods of coupling a first tree portion to a second tree portion as described above, and as claimed.

In one such embodiment, the claimed invention comprises a method of electrically and mechanically coupling a first tree portion of a lighted artificial tree to a second tree portion. The method comprises aligning a first tree portion having a first generally hollow trunk portion and an electrical connector, along a vertical axis; aligning a second tree portion having a second generally hollow trunk portion and a second electrical connector along the vertical axis; causing one of the first or the second tree portions to move axially such that the second tree portion receives an end of the first tree portion, and the first trunk wall is engaged with the second trunk wall; causing the first electrical connector at a first sloped engagement portion to initially contact a second sloped engagement portion of the second electrical connector prior to a final engagement position, and at a first rotational alignment; allowing a torque caused by a downward force of a weight of the second tree portion to rotate the second electrical connector relative the first electrical connector, thereby rotating the first tree portion into a final rotational alignment with the second tree portion.

The embodiments above are intended to be illustrative and not limiting. Additional embodiments are within the claims. In addition, although aspects of the present invention have been described with reference to particular embodiments, those skilled in the art will recognize that changes can be made in form and detail without departing from the spirit and scope of the invention, as defined by the claims.

Persons of ordinary skill in the relevant arts will recognize that the invention may comprise fewer features than illustrated in any individual embodiment described above. The embodiments described herein are not meant to be an exhaustive presentation of the ways in which the various features of the invention may be combined. Accordingly, the embodiments are not mutually exclusive combinations of features; rather, the invention may comprise a combination of different individual features selected from different individual embodiments, as understood by persons of ordinary skill in the art.

Any incorporation by reference of documents above is limited such that no subject matter is incorporated that is contrary to the explicit disclosure herein. Any incorporation by reference of documents above is further limited such that no claims included in the documents are incorporated by reference herein. Any incorporation by reference of documents above is yet further limited such that any definitions provided in the documents are not incorporated by reference herein unless expressly included herein.

For purposes of interpreting the claims for the present invention, it is expressly intended that the provisions of Section 112, sixth paragraph of 35 U.S.C. are not to be invoked unless the specific terms "means for" or "step for" are recited in a claim.

What is claimed:

1. An artificial tree, comprising:

a first tree portion with a first trunk portion defining a first lengthwise axis, a first plurality of branches connected to the first trunk portion, a first light string and a first connector with first electrical contacts, wherein the first connector includes a plurality of evenly-spaced, non-conductive anti-rotation projections projecting in a direction substantially parallel to the lengthwise axis of the first trunk portion; and a second tree portion with a second trunk portion defining a second lengthwise axis, a second plurality of branches connected to the second trunk portion, a second light string and a second connector with second electrical contacts, wherein the second connector includes a plurality of evenly-spaced, anti-rotation gaps configured to receive the plurality of evenly-spaced, non-conductive anti-rotation projections, and wherein when the first tree portion is coupled to the second tree portion, the first lengthwise axis is aligned with the second lengthwise axis, and the first connector couples to the second connector, such that the evenly-spaced, non-conductive anti-rotation projections are received by the evenly-spaced, non-conductive anti-rotation gaps, thereby restricting circumferential rotation of the first tree portion relative to the second tree portion.

2. The artificial tree of claim 1, wherein upon coupling of the first connector to the second connector, the first electrical contacts become electrically connected to the second electrical contacts.

3. The artificial tree of claim 2, wherein a first electrical contact of the first electrical contacts is configured to connect to a first electrical contact of the second electrical contacts at a first position, and a second electrical contact of the first electrical contacts is configured to connect to a second electrical contact of the second electrical contacts at a second position, and wherein the first position is displaced axially from the second position.

4. The artificial tree of claim 3, wherein the first electrical contacts include three or more electrical contacts electrically isolated from each other, and the second electrical contacts include three or more electrical contacts electrically isolated from each other.

5. The artificial tree of claim 4, wherein the first electrical contacts include four electrical contacts and the second electrical contacts include four electrical contacts.

6. The artificial tree of claim 5, wherein each of the four electrical contacts are axially displaced from one another.

7. The artificial tree of claim 4, wherein the first electrical contacts includes a central contact aligned along the first lengthwise axis.

8. The artificial tree of claim 1, wherein the first and second plurality of branches are pivotally connected to the first and second trunk portions, respectively.

9. The artificial tree of claim 8, wherein the evenly-spaced, non-conductive projecting portions comprise a substantially U-shape when viewed radially.

10. The artificial tree of claim 8, wherein the first light string comprises first light-emitting diodes (LEDs) and light string wiring affixed to the first plurality of branches.

11. The artificial tree of claim 10, wherein the first LEDs are connected in parallel.

12. The artificial tree of claim 11, further comprising second LEDs, the second LEDs electrically connected to the first LEDs in series.

13. The artificial tree of claim 12, wherein the first light string is electrically connected to the second light string in parallel when the first tree portion is coupled to the second tree portion.

14. The artificial tree of claim 13, wherein the first connector is located entirely inside the first trunk portion.

15. The artificial tree of claim 14, wherein the first tree portion includes a greater quantity of LEDs as compared to the second tree portion.

16. The artificial tree of claim 15, wherein each of the evenly-spaced, non-conductive projecting portions defines a rounded end to facilitate guiding the projecting portions into the evenly-spaced gaps when the first tree portion is being coupled to the second tree portion.

17. The artificial tree of claim 1, wherein each of the evenly-spaced, non-conductive projecting portions defines a rounded end to facilitate guiding the projecting portions into the evenly-spaced gaps when the first tree portion is being coupled to the second tree portion.

18. The artificial tree of claim 1, wherein the first light string comprises two independent light strings connected together.

19. The artificial tree of claim 18, wherein the two independent light strings are electrically connected to one another in parallel.

20. The artificial tree of claim 19, wherein the first and second LEDs operate on direct-current power.

* * * * *